US011339504B2

(12) United States Patent
Suzuki

(10) Patent No.: US 11,339,504 B2
(45) Date of Patent: May 24, 2022

(54) PROCESS FOR PRODUCING ELASTIC FIBER, PROCESS FOR PRODUCING ELASTIC FIBER ARTICLE, ELASTIC FIBER AND ELASTIC FIBER ARTICLE

(71) Applicant: BASF SE, Ludwigshafen am Rhein (DE)

(72) Inventor: Yasuyuki Suzuki, Yokkaichi (JP)

(73) Assignee: BASF SE, Ludwigshafen am Rhein (DE)

( * ) Notice: Subject to any disclaimer, the term of this patent is extended or adjusted under 35 U.S.C. 154(b) by 240 days.

(21) Appl. No.: 16/478,344

(22) PCT Filed: Feb. 8, 2018

(86) PCT No.: PCT/EP2018/053171
§ 371 (c)(1),
(2) Date: Jul. 16, 2019

(87) PCT Pub. No.: WO2018/146192
PCT Pub. Date: Aug. 16, 2018

(65) Prior Publication Data

US 2019/0368075 A1 Dec. 5, 2019

(30) Foreign Application Priority Data

Feb. 10, 2017 (JP) ..... JP2017-023520
Mar. 16, 2017 (EP) ..... 17161361

(51) Int. Cl.
*D01D 5/10* (2006.01)
*D01F 6/70* (2006.01)
*D01D 1/06* (2006.01)

(52) U.S. Cl.
CPC ..... *D01D 5/10* (2013.01); *D01D 1/06* (2013.01); *D01F 6/70* (2013.01)

(58) Field of Classification Search
CPC ..... D01D 5/10; D01D 1/06; D01D 1/065
See application file for complete search history.

(56) References Cited

U.S. PATENT DOCUMENTS 4,330,989 A * 5/1982 Schmieder ..... D02G 1/0286 57/227
5,281,476 A * 1/1994 Koyonagi ..... D01D 5/23 428/357

(Continued)

FOREIGN PATENT DOCUMENTS

EP 0 295 271 A1 12/1988
EP 0 548 364 A1 6/1993

(Continued)

OTHER PUBLICATIONS

International Search Report and Written Opinion dated May 8, 2018 in PCT/EP2018/053171, 14 pages.

(Continued)

*Primary Examiner* — Niki Bakhtiari
*Assistant Examiner* — Emmanuel S Luk
(74) *Attorney, Agent, or Firm* — Grüneberg and Myers PLLC

(57) ABSTRACT

A process for producing an elastic fiber comprising: melt-spinning a raw material composition, which comprises a thermoplastic polyurethane elastomer, at a spinning rate of 2,500 m/min to 10,000 m/min. The thermoplastic polyurethane elastomer comprises soft-segments obtained by reacting a polyether polyol as a long chain polyol.

12 Claims, 22 Drawing Sheets

(56) References Cited

U.S. PATENT DOCUMENTS 5,308,697 A 5/1994 Muramoto et al.
5,959,059 A * 9/1999 Vedula ..... D01F 6/70 528/76
6,096,252 A 8/2000 Umezawa et al.
6,495,078 B1 * 12/2002 Kurihara ..... D01D 5/0985 264/70
2002/0031663 A1 * 3/2002 Yu ..... D01F 6/60 264/78
2002/0161159 A1 * 10/2002 Vedula ..... C08G 18/4854 528/44
2003/0190383 A1 * 10/2003 Kim ..... D01D 5/0084 425/110
2004/0230012 A1 11/2004 Vedula et al.
2005/0106982 A1 5/2005 Berrigan et al.
2006/0266462 A1 11/2006 Berrigan et al.
2006/0270303 A1 11/2006 Berrigan et al.
2010/0090365 A1 * 4/2010 Schuette ..... C08J 3/091 264/178 F
2010/0216905 A1 * 8/2010 Kuwamura ..... C09D 175/14 521/170
2010/0275568 A1 * 11/2010 Chikatsune ..... C08G 63/6886 57/247
2017/0073466 A1 * 3/2017 Kusano ..... C09J 175/06
2017/0253698 A1 * 9/2017 Taniguchi ..... C08G 65/20
2018/0051392 A1 * 2/2018 Hah ..... D01D 5/084
2019/0226123 A1 * 7/2019 Wamprecht ..... D01D 5/08

FOREIGN PATENT DOCUMENTS

EP 2 811 054 A1 12/2014
JP 2005-281901 A 10/2005
JP 2013-241701 A 12/2013
WO WO 88/04703 A1 6/1988
WO WO 2004/092241 A1 10/2004
WO WO 2014/189993 A1 11/2014

OTHER PUBLICATIONS

International Preliminary Report on Patentability dated May 15, 2019 in PCT/EP2018/053171, 15 pages.

* cited by examiner (a)

(b)

(c)
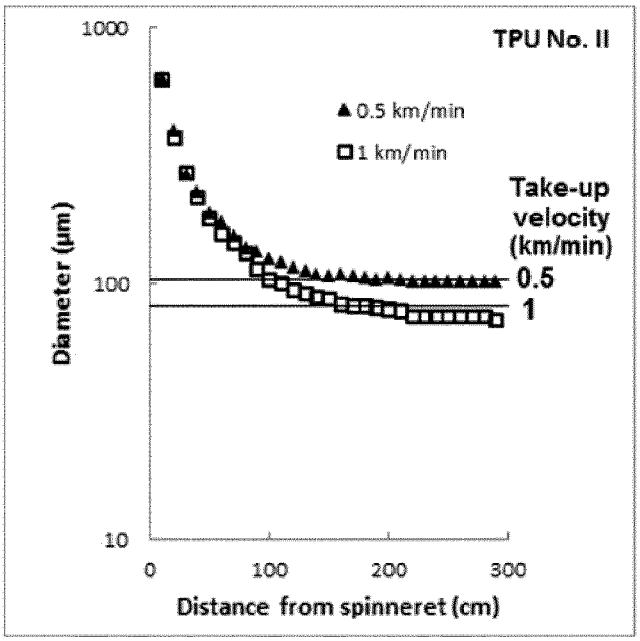
(d)
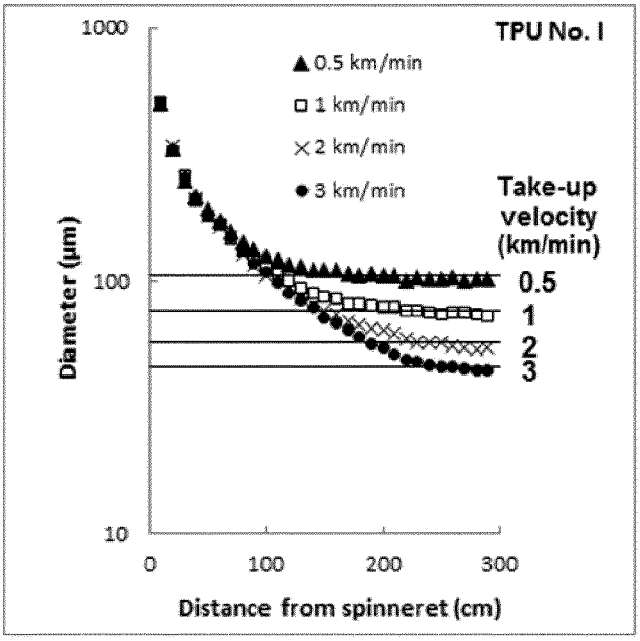

(a)

(b)

(c)
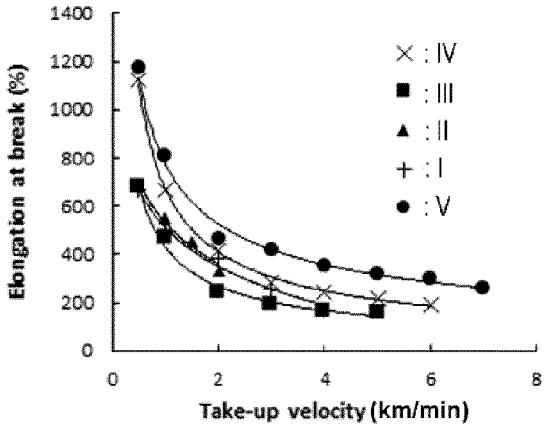
(d)
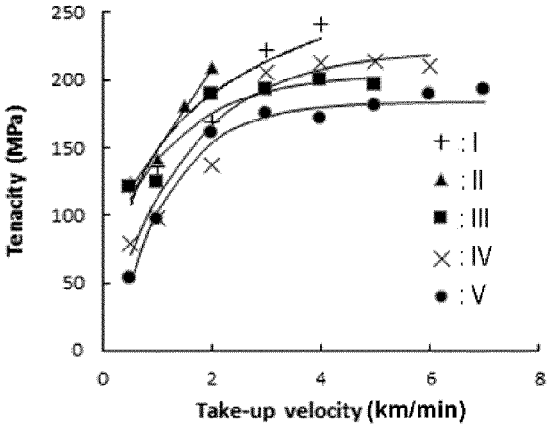

(a)

(b)

(c)
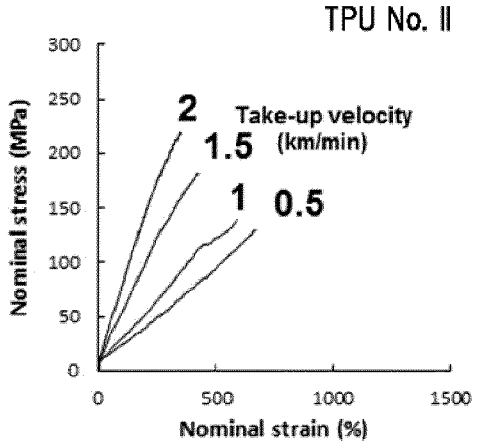
(d)
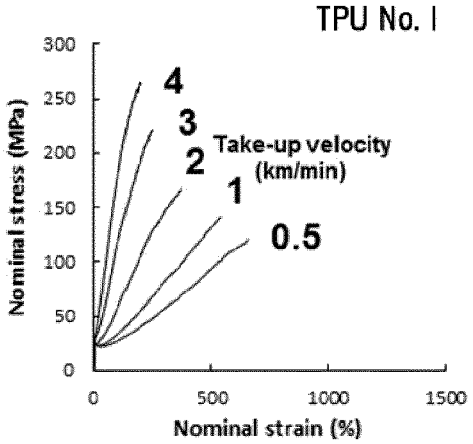

(a)

(b)

(c)
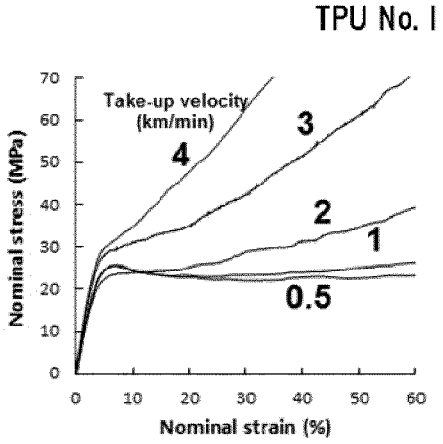

(a)

(b)

(a)

(b)

(c)
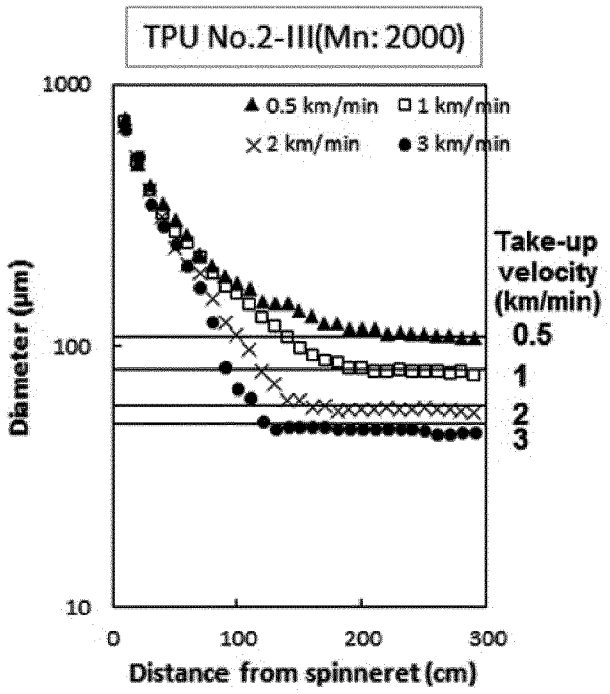
(d)
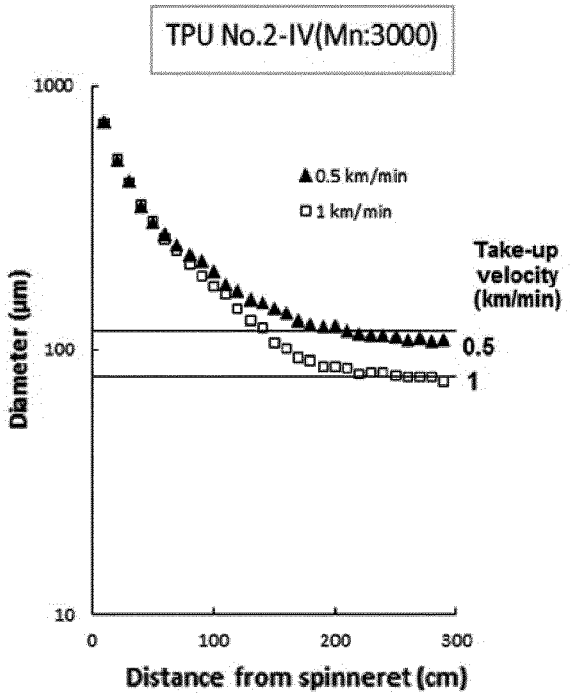

(a)

(b)

(c)
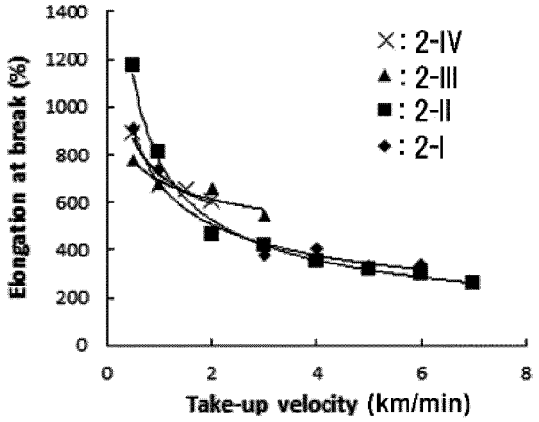
(d)
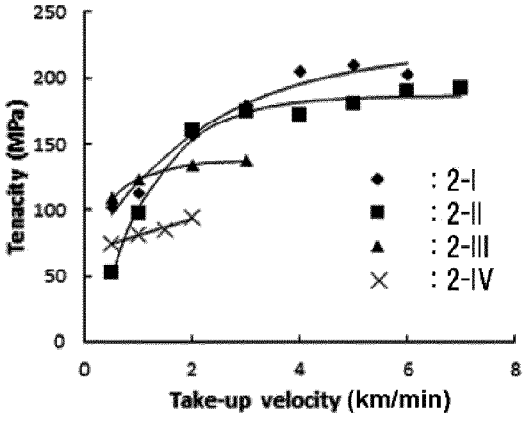

PROCESS FOR PRODUCING ELASTIC FIBER, PROCESS FOR PRODUCING ELASTIC FIBER ARTICLE, ELASTIC FIBER AND ELASTIC FIBER ARTICLE

TECHNICAL FIELD OF THE INVENTION

The present invention relates in particular to a method, also referred to as process, for producing elastic fiber by using thermoplastic polyurethane, a method, also referred to as process for producing an elastic fiber article by using the elastic fiber, and elastic fiber and elastic fiber articles.

BACKGROUND ART

Fibers having rubber-like elasticity, namely, elastic fibers (JIS L0204-3) have hitherto been widely used in various fields involving industrial materials as well as clothing materials; as the raw materials for such elastic fibers, for example, thermoplastic polyurethane (TPU), thermoplastic polyether ester amide (TPA), and thermoplastic polyolefin (TPO) are widely known.

Among these, in particular, fibers using TPU are excellent in, for example, chemical resistance, wear resistance, weight saving of articles and adhesiveness with other materials. TPU is generally obtained by reacting an organic isocyanate, a long chain polyol and a chain extender. Among of TPU fibers, especially when using a polyether polyol as the long chain polyol, it is possible to obtain TPU fibers being excellent in low temperature resistance, microorganism corrosion resistance and water resistance such as hydrolysis-resistance.

However, TPU fibers are usually not sufficient with respect to the mechanical properties such as the tensile elastic modulus and tensile strength as compared with nylon (such as PA66) and polyester (such as PET) fibers. Further, when using polyether polyol as the long chain polyol, fibers tend to be inferior in mechanical properties such as tenacity, comparing other long chain polyols such as polyester polyol and polycarbonate polyol.

SUMMARY OF INVENTION

Accordingly, an object of the present invention is to provide a process capable of producing TPU improved in mechanical properties even when using a polyether polyol(s) as the long chain polyol.

As disclosed in Patent Literature 1 (Japanese Patent Laid-Open No. 2005-281901), the spinning rate of a TPU fiber being approximately 450 m/min to 1,000 m/min is generally regarded as suitable from the viewpoint of, for example, the improvement of tenacity (paragraph 0055, Patent Literature 1). Patent Literature 2 (Japanese Patent Laid-Open No. 2013-241701) discloses a polyurethane resin, as an example of a high-speed-spinnable resin for an elastic fiber; however, the disclosure only suggests the capability of being used together with a plurality of resins such as polyether ester resin, and the high-speed spinning of the polyurethane resin has never been investigated. Besides, Patent Literature 2 merely discloses a polyester-based TPU comprising a polyalkylene ester polyol prepared from adipic acid and 1,4-butane diol, as a long chain unit for a soft segment (paragraph 0060 of Patent Literature 2).

Patent Literature 3 (WO2004/092241A1) discloses a TPU fiber and melt-spinning method thereof. However, Patent Literature 3 essentially needs the use of a specific crosslinker and such crosslinker may deteriorate the desirable properties of fibers. Besides, Patent Literature 3 merely discloses lower speed spinning 300-1,200 m/min for TPU melt spun (paragraph 0040) and its working example tries the speed at 480 m/min only.

Patent Literature 4 (EP0548364A1) shows a melt spinning at higher spinning speed. However, Patent Literature 4 recognizes the difficulty of the polyurethane spinning and they achieve the high speed spinning by incorporating polyester resin (composite filament). Such composite filament requires a complicated nozzle for the spinning and the cost is increased while the yield is decreased.

Patent Literature 5 (US2005/106982A1) discloses a spinning method and the use of Huntsman polyurethane. However, Huntsman polyurethane is prepared by using polyester polyol as the long chain polyol. Besides, the method of Patent Literature 5 is for preparing a coherent nonwoven fibrous web. Although the filament speed is even 2,800 m/min or more, it is for spinning very fine filaments as intermediates of the final product (web) and the web is taken up by a roll 23 at much lower speed.

Patent Literature 6 (U.S. Pat. No. 6,096,252A) discloses TPU fibers and spinning method thereof. However, Patent Literature 6 merely discloses a general spinning method at lower speed, 2,000 m/min or less. Furthermore, any of Patent Literatures 1 to 6 recognize problems when polyether polyol is mainly used as the long chain polyol.

The present inventors made a continuous diligent study, and surprisingly found that the increase of the spinning rate leads to a dramatic improvement of the mechanical properties of the TPU fiber even when using a polyether polyol as the long chain polyol, and thus have perfected the present invention.

Specifically, the present invention relates to a process for producing elastic fiber, and the process is a method for producing an elastic fiber by using as a raw material a thermoplastic polyurethane elastomer, namely, a TPU containing soft segments and hard segments, and by melt spinning a raw material composition including the TPU at a spinning rate of more than 2,000 m/min to 10,000 m/min, preferably 2,500 m/min or more, more preferably 3,000 m/min or more, especially more than 3,000 m/min, particularly 3,500 m/min or more, even 4,000 m/min or more.

The preferred mode of the present invention is as follows.

The soft segments of TPU are generally produced by reacting a long chain polyol and an isocyanate, and the long chain polyol used as a raw material is preferably allowed to include polyols having number average molecular weights (Mn) of less than 3,000, preferably less than 2,000, in a content of 50% by mass or more. The long chain polyol hereinafter is also referred to as polyol.

Preferably one or more crosslinker are added to the raw material composition. It is preferable to use a polyether crosslinker comprising one or more of polyether units within its chemical structure. Alternatively or in addition to, other crosslinker such as a non-polyether crosslinker may be used, however, it is better to reduce the amount of the non-polyether crosslinker to less than 5% by mass (5 wt. %), based on the total amount of the raw material composition.

The hardness of the TPU is not particularly limited, but preferably has a Shore hardness of 74 D or less. In addition, the Shore hardness of TPU of 70 D or less, preferably 64 D or less more improves the elastic recovery and the energy loss.

The hard segment content of the TPU is not particularly limited, and is for example 10% by mass to 90% by mass, preferably less than 60% by mass, even less than 50% by mass.

The present invention also includes elastic fiber obtained by the above-described process, a process for producing an elastic fiber article by using the elastic fiber, and the elastic fiber article obtained by the production process.

According to the present invention, it is possible to obtain a TPU elastic fiber improved in mechanical properties while the properties of the TPU fiber such as chemical resistance are being maintained.

DETAILED DESCRIPTION OF THE INVENTION

Hereinafter, the present invention is specifically described, but the present invention is not limited to the specific examples.

The process for producing elastic fiber of the present invention includes a step of melt spinning of a raw material composition including a thermoplastic polyurethane elastomer (TPU). Hereinafter, the production process (method) is described in more detail.

Melt Spinning

Melt spinning is a technique in which a raw material composition in a molten state obtained by heating the raw material composition to a temperature equal to or higher than the melting point by using an extruder or the like is discharged from a spinning nozzle into a gas phase (for example, into the air or into the air cooled if necessary). The positioning of the nozzle is not limited, however, it is preferable to direct the nozzle downward so that the molten composition (yarn, fiber) is discharged downward (drawn down). The discharged molten yarn is cooled and solidified in the gas phase while being made fine, and then is taken up at a certain speed.

It is also possible to melt a main component (elastomer) of the raw material composition separately from other component(s) of the raw material composition so that the molten main component is mixed with others just before discharging from the nozzle.

Figure 1:
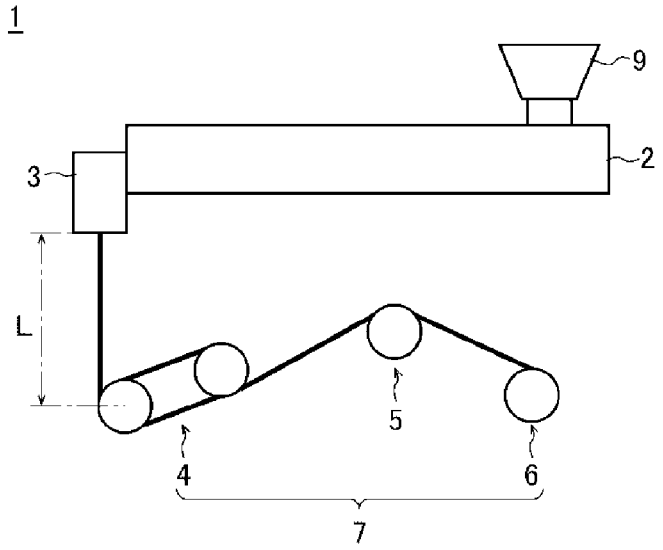
FIG. 1 is a side view illustrating an example of an apparatus for producing fiber.

The apparatus used in the present invention is not particularly limited, and an example thereof is shown in FIG. 1. An apparatus 1 for producing fiber includes an extruder 2, a spinning head 3 and a winder 7. A raw material composition or the main component thereof, for example, formed as pellets are fed from a feed opening 9 to the extruder 2, melted in the extruder 2, and then discharged to be a molten yarn from the nozzle (spinning nozzle) of a spinning head 3 into a gas phase.

When using one or more additive (the other component) such as a crosslinker, at least one mixer such as a static or a dynamic mixer, preferably a static mixer may be provided in the apparatus 1. In this case, the main component comprising the elastomer, in one preferred embodiment consisting of the elastomer is molten in the extruder separately from the crosslinker; the crosslinker is mixed with the molten main component by using the mixer; and then the mixed composition in a molten state (i.e., the raw material composition in the molten state) is discharged from the nozzle of the spinning head 3. The elastomer of the raw material composition is crosslinked with the crosslinker during the melt spinning process.

The gas phase is not particularly limited, can be various gas phases such as an inert gas atmosphere and the air atmosphere, and is the air atmosphere (air) from the viewpoint of the cost. The temperature of the gas phase can be any temperature lower than the melting point of the raw material composition, and is −10° C. to 50° C. and more preferably 10° C. to 40° C. in consideration of the cost.

The discharged molten yarn is made fine while being cooled while the yarn is traveling in the gas phase, thus turns into an elastic fiber and is taken up by a winder 7. The winder 7 is not particularly limited; the winder 7 usually has one or more godet rollers 4 and 5.

In one preferred example at least one part of the winder 7, in a preferred example, one godet roller 4 is arranged below the spinning head 3 so that the molten yarn is drawn down from the nozzle of the spinning head 3 to the winder 7. Here, the meaning of "drawn down" is not specifically limited to a travelling direction parallel to the vertical direction (vertically downward). The travelling direction of the yarn/fiber can be inclined, in a preferred example, at an angle of 10 degrees or less, preferably 5 degrees or less, relative to the vertical direction.

The molten yarn (inclusive of an elastic fiber being cooled or after cooling) travels by the rotation of godet rollers 4 and 5, and then the yarn is taken up around a take-up roll 6 (bobbin) at a take-up speed (winding speed), in a preferred example, 2,500 m/min or more. As the result, the yarn (fiber) travels from the nozzle of the spinning head 3 to the take-up roll 6 of the winder 7 at a spinning rate of 2,500 m/min or more. The spinning rate may preferably be 3,000 m/min or more, especially more than 3,000 m/min, particularly 3,500 m/min or more, even more preferred 4,000 m/min or more.

It is to be noted that the constitution of the winder 7 is not limited to what has been described above. In the present invention, in order to improve the fiber properties by the control of the spinning rate, at least one godet roller 4 is allowed to be a nelson roller, and the variation of the spinning rate due to the slip between the roller and the yarn can also be suppressed.

The elastic fiber of TPU has hitherto been generally spun at a speed of a few hundred m/min to less than 1,000 m/min. In the present invention, by setting the spinning rate as above, the mechanical properties of the TPU elastic fiber can be improved even when using a polyether polyol as a long chain polyol unit for the TPU elastomer of the raw material composition.

The upper limit of the spinning rate is not particularly limited; as described below, the upper limit of the spinning rate can be appropriately varied according to the TPU used for the raw material composition, but is 10,000 m/min or less, preferably 9,000 m/min or less for the purpose of stably controlling the apparatus.

In the present invention, the spinning rate means, for example, the speed between the nozzle of the spinning head 3 and the first take-up roll 6 of the winder 7, and it is almost same as the take-up speed.

The spinning conditions other than the spinning rate are not particularly limited, but are preferably set as follows.

Spinning Path Length

Reference character L of FIG. 1 denotes the spinning path length, the distance from the nozzle of the spinning head 3 to the winder 7; from the viewpoint of the cooling of the molten resin, the spinning path length L is usually 50 cm or more and is more preferably set to be 100 cm or more. When the spinning path length L is elongated, the air resistance stress is also increased, and hence the spinning path length is usually set to be 800 cm or less, preferably to be 500 cm or less and more preferably to be 300 cm or less.

Spinning Temperature

The spinning temperature is defined as, for example, the heating temperature in the extruder 2. The spinning temperature is not particularly limited, and can be appropriately varied according to the melting point of the raw material composition; from the viewpoint of spinnability, the spinning temperature is usually 180° C. or higher, preferably 200° C. or higher, more preferably 230° C. or higher and particularly preferably 235° C. or higher. Especially when using a TPU elastomer having high hardness (for example, shore 50 D or more), a higher spinning temperature (for example, more than 230° C., preferably 235° C. or more) enables the spinning at a higher spinning rate. From the viewpoint of the suppression of the thermal decomposition of the raw material composition, the spinning temperature is usually 260° C. or lower, and preferably 250° C. or lower.

When the spinning temperature is set to be high, the crystallization rate is suppressed, and due to the effect of the suppressed crystallization rate, the diameter on the spinning line tends to be increased. When the spinning temperature is set to be high, the elongation at break tends to be decreased and the elastic contraction C tends to be small. Depending on the differences of the properties (such as the Shore hardness, the hard segment content, and the molecular weight of (b) long chain polyol) of the TPU, the variation of the spinnability due to the effect of the spinning temperature is different, and hence the spinning temperature can be appropriately varied within the above-described preferable range in accordance with the properties of the TPU.

Nozzle Diameter

From the viewpoint of the discharge pressure, the nozzle diameter (diameter) of the spinning head 3 is 0.2 mm or more, preferably 0.3 mm or more, more preferably 0.5 mm or more and particularly preferably 0.8 mm or more; from the viewpoint of the discharge stability, the nozzle diameter of the spinning head 3 is usually 3.0 mm or less, preferably 2.0 mm or less, more preferably 1.5 mm or less and particularly preferably 1.2 mm or less.

The type of nozzle is not limited. For example, it is not necessary to use a nozzle having a complicated structure such as a conjugated spinning nozzle for discharging two or more components separately (a composite fiber). In other words, the invention may use an ordinary spinning nozzle, as a preferred example, a nozzle for discharging only one raw material composition. As the result, it is possible to obtain an elastic fiber made from only one raw material composition. Such fiber has a cross section where no phase or island is observed and 99% or more of the cross sectional area is occupied by only one material. In other words, 99 vol. % or more of the fiber is occupied by only one raw material composition, preferably the fiber essentially consists of only one raw material composition.

Discharge Rate

From the viewpoint of the spinning stability, the discharge rate per a single nozzle hole (single hole) is usually set to be 0.2 g/min or more and preferably 0.4 g/min or more; from the viewpoint of the fineness control, the discharge rate per a single nozzle hole is usually set to be 7.0 g/min or less, preferably 5.0 g/min or less and more preferably 3.0 g/min or less.

Such spinning conditions as described above can be optionally selected according to the mutual relations among the conditions, the types of the TPU and the types of the additives used in the raw material composition, the design of the whole of the spinning apparatus 1 and the properties of the article fiber (such as the fiber diameter and the number of the filaments). Next, the raw material composition used in the present invention is described.

Raw Material Composition

The raw material may comprise an elastomer comprising, more preferred essentially consisting of a TPU. The term "essentially consisting" means the elastomer comprises the TPU and optionally unintended materials such as residues, contaminants or the like. In other words, the elastomer comprises 95% by mass (wt. %) or more of TPU(s), preferably 99 wt. % or more, more preferably 99.5 wt. % more, especially 99.9 wt. % or more, even 100 wt. % of TPU(s). Such TPU is not limited and one or more of TPUs can be used as an elastomer. Hereinafter, the preferable TPUs will be explained.

TPU (Thermoplastic Polyurethane Elastomer)

The TPU is generally obtained, without being particularly limited, by allowing a (a) isocyanate preferably, an organic diisocyanate, a (b) long chain polyol preferably a polyester polyol or a polyether polyol, more preferably polyether polyol and in further preferred embodiments a (c) chain extender (a polyol shorter in the chain length than the long chain polyol, usually a short chain diol) as the essential components to react with each other, if necessary, in the presence of a (d) catalyst and/or an (e) aid (auxiliary agent). The short chain diol is also referred to as chain extender. In a preferred embodiment the chain extender has a molecular weight from 50 g/Mol to 499 g/Mol. The polyol, also referred to as long chain polyol has a number average molecular weight from 500 g/Mol to $10\times10^3$ g/Mol. The reaction can be a one-stage reaction allowing the whole of the essential components (a) to (c) to react with each other in one stage, in preferred embodiment in the presence of the optional components (d) and (e), or a reaction having a plurality of stages allowing two or more components of (a) an (b) to react with each other to form a prepolymer and then allowing the prepolymer and the rest of the essential components to react with each other, preferably in the presence of the components (d) and (e).

The hardness of the TPU is affected by the ratio (mass ratio) between the hard segments formed by reacting (c) chain extender and (a) isocyanate and the soft segments formed by reacting (b) long chain polyol and (a) isocyanate, and is affected by the structure (for example, the fraction of the isocyanate) of the hard segments. The following formula (1) shows an example of the hard segments.

[Formula 1]

(1)

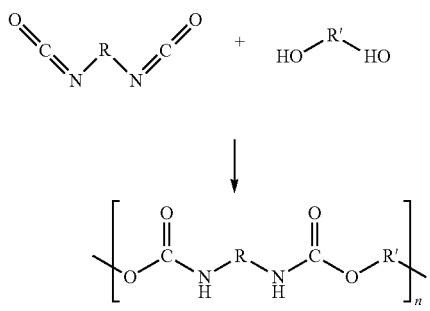

The upper half of formula (1) shows (a) isocyanate and (c) chain extender, and the reaction between these components yields the hard segment structure shown in the lower half of formula (1). The hard/soft segment ratio can be defined by, for example, the proportion of the total mass of the above-described hard segment structure in the mass of the whole of the TPU (the hard segment content, % by mass). More specifically, the hard segment content can be defined as the proportion of the total of the mass of (c) chain extender and the mass of (a) isocyanate to react with the chain extender (usually, the molar amount of (a) is same as the molar amount of (c)) in the mass of the whole of the TPU. In the TPU used in the present invention, the hard segment content is, for example, 10% by mass to 90% by mass, preferably 25% by mass to 75% by mass and more preferably 30% by mass to 60% by mass, especially less than 50% by mass.

The hard segment content also referred to as rigid phase fraction is calculated by the following formula.

$$\text{Rigid phase fraction} = \left\{\sum_{x=1}^{k} [(m_{KVx} / M_{KVx}) * M_{Iso} + m_{KVx}]\right\} \Big/ m_{ges}$$

with the following meanings:

$M_{KVx}$: molar mass of the chain extender x in g/mol $m_{KVx}$: mass of the chain extender x in g $M_{Iso}$: molar mass of the isocyanate used in g/mol $m_{ges}$: total mass of all starting materials in g k: number of chain extenders The hardness of the TPU is not particularly limited, but is generally Shore 70 A to Shore 80 D and preferably Shore 75 A to Shore 74 D. However, when the hardness is too high, the achievement of a high spinning rate is difficult, the elastic recovery and the energy loss rate tend to be degraded; thus, when these properties are necessary, the Shore hardness of the TPU is set to be 74 D or less and preferably 70 D or less, more preferably 64 D or less.

As (a) isocyanate, it is possible to use generally known aromatic, aliphatic, alicyclic and/or araliphatic isocyanates, and preferably diisocyanates are used. Specifically, it is possible to use one or more selected from, for example, the following: 2,2'-, 2,4' and/or 4,4'-diphenylmethane diisocyanate (MDI), 1,5-naphthylene diisocyanate (NDI), 2,4- and/or 2,6-tolylene diisocyanate (TDI), diphenylmethane diisocyanate, 3,3'-dimethyldiphenyl diisocyanate, 1,2-diphenylethane diisocyanate and/or phenylene diisocyanate, tri, tetra, penta, hexa, hepta and/or octamethylene diisocyanate, 2-methylpentamethylene-1,5-diisocyanate, 2-ethylbutylene-1,4-diisocyanate, 1,5-pentamethylene diisocyanate, 1,4-butylene diisocyanate, 1-diisocyanato-3,3,5-trimethyl-5-isocyanatomethyl cyclohexane (isophorone diisocyanate, IPDI), 1,4- and/or 1,3-bis(isocyanatomethyl) cyclohexane (HXDI), 1,4-cyclohexane diisocyanate, 1-methyl-2,4- and/or -2,6-cyclohexane diisocyanate and/or 4,4'-, 2,4'- and 2,2'-dicyclohexylmethane diisocyanate. More preferable isocyanates are 2,2'-, 2,4'- and/or 4,4'-diphenylmethane diisocyanate (MDI), 1,5-naphthylene diisocyanate (NDI), 2,4- and/or 2,6-tolylene diisocyanate (TDI), hexamethylene diisocyanate and/or IPDI, in particular, 4,4'-MDI and/or hexamethylene diisocyanate, and the most preferable isocyanate is MDI.

As (b) long chain polyol, compounds generally known as isocyanate reactive compounds can be used. For example, polyesterol, polyetherol and/or polycarbonatediol can be used; these are customarily covered by the term "polyol"; the generally used polyols have number average molecular weights of, for example, 500 g/Mol to 8,000 g/Mol, preferably 600 g/Mol to 6,000 g/Mol. However, as described below, in order to increase the spinning rate, the number average molecular weight of the (b) long chain polyol is preferably less than 3,000 and more preferably less than 2,000 g/Mol, especially less than 1,500 g/Mol, more especially 1,200 g/Mol or less and even 1,000 or less. The lower limit of the molecular weight is preferably 500, more preferably 600 and particularly preferably 700. In one preferred embodiment the polyol has a molecular weight between 800 g/Mol and $1.2\times10^3$ g/Mol. Molecular masses of polyols referred to in this application are number average molecular weights.

When two or more types of (b) long chain polyols are used as the raw materials of TPU, the content of the polyols each having such an appropriate molecular weight as described above (for example, less than 3,000 g/Mol) is preferably 50 parts by mass or more, more preferably 70 parts by mass or more and particularly preferably 90 parts by mass or more, in relation to 100 parts by mass of the total amount of (b) long chain polyols; it is most preferable to use (b) long chain polyol substantially composed of the polyols having the appropriate molecular weights.

The other properties of (b) long chain polyol are not particularly limited; however, for example, the average functional value in relation to isocyanate is preferably 1.8 to 2.3, more preferably 1.9 to 2.2 and particularly preferably 2 (diisocyanate). It is to be noted that unless otherwise specified, the molecular weight means the number average molecular weight Mn (g/mol).

When focusing attention on the chemical structure other than the molecular weight, one or two or more types of (b) long chain polyols can be used. It is inferred that even when any of (b) long chain polyols, namely, a polyester-based, polyether-based or polycarbonate-based polyol is used, theoretically a high effect is obtained. Among of such polyols, polyether-based polyol (polyether polyol) may be preferably used, considering desirable fiber properties such as low temperature resistance, microorganism corrosion resistance and water resistance.

When (b) long chain polyol based on polyether is used, it is possible to use at least one of polyesterol and polycarbonate diol together with polyetherol (polyether polyol). However, it is preferable to use the polyether polyol as the main component of (b) long chain polyol (polyether-based TPU), in other words, at least 50 mass % (wt. %) of (b) long chain polyol may consist of one or more polyether polyols. More preferably, (b) long chain polyol comprises 80 wt. % or more of polyether polyol, especially 95 wt. % or more of polyether polyol, and even (b) long chain polyol may essentially consist of polyether polyol. Examples of the useful polyetherol include so-called low unsaturated polyetherols.

In the present invention, the low unsaturated polyol is, in particular, a polyether alcohol including an unsaturated compound in a content of less than 0.02 meg/g, preferably less than 0.01 meg/g. Examples of such a polyether alcohol include: a ring-opening polymer of tetrahydrofuran (polytetramethylene glycol, PTMEG), alkylene oxides (in particular, ethylene oxide, propylene oxide and mixtures of these) and alcohol adducts. As the long chain polyol (b), PTMEG is most preferable from the viewpoint of, for example, the flexibility, tenacity and durability of the TPU produced by using PTMEG. However, when the heat resistance and the like are required, a preferable polyol is not limited only to PTMEG.

(c) chain extender is a short chain polyol having a molecular weight smaller than the molecular weight of the long chain polyol (b), and is specifically a bifunctional compound (diol) having a molecular weight of 50 to 499. Examples of the short chain polyol used as (c) chain extender include generally known aliphatic, araliphatic, aromatic and/or alicyclic compounds. Specific examples of the short chain polyol include alkane diols (having 2 to 10 carbon atoms in the alkylene group), in particular, 1,3-propanediol, 1,4-butanediol, 1,6-hexanediol, and/or di, tri, tetra, penta, hexa, hepta, octa, nona and/or decaalkylene glycol (having 3 to 8 carbon atoms), and the corresponding oligo and/or polypropylene glycol. (c) chain extenders can be used each alone or in combinations of two or more thereof. A particularly preferable (c) chain extender is 1,4-butanediol.

In order to regulate the hardness of the TPU, the molar ratios between the constitutional unit components (b) and (c) can be varied over relatively wide ranges of molar ratios. The molar ratio of the component (b) to the total amount of the chain extender (c) is 10:1 to 1:10, in particular the range from 1:1 to 1:4 is useful, and with the increase of the content of (c), the hardness of the TPU is increased.

Examples of (d) catalyst, an optional component, without being particularly limited to:

trimethylamine, dimethylcyclohexylamine, N-methylmorpholine, N,N'-dimethylpiperazine, 2-(dimethylaminoethoxy)ethanol, diazabicyclo(2,2,2)octane and the analog thereof; further, in particular, organometallic compounds such as titanium ester; iron compounds such as iron (III) acetylacetonate; tin compounds such as tin diacetate, tin dioctoate and tin dilaurate; and tin dialkyl salts of aliphatic carboxylic acids such as dibutyltin diacetate and dibutyltin dilaurate and the equivalents thereof. The catalyst is usually used in an amount of 0.0001 to 0.1 part by mass in relation to 100 parts by mass (b) long chain polyol.

Examples of the aid (e), an optional component, include: a surfactant, a nucleating agent, gliding and demolding aids, a dye, a pigment, an antioxidant (for example, in relation to hydrolysis, light, heat and discoloration), a flame retardant, a reinforcing agent and a plasticizer, a metal deactivator and a cross-linking agent; one or more selected from these can be used.

As the TPU produced from the components (a) to (c), and optionally from (d) and (e), commercially available products can also be used. As the commercially available products, the following commercially available thermoplastic polyurethane-based elastomer resins may be used: Pandex T-1185N and T-1190N manufactured by DIC Bayer Polymer Ltd.; Miractran manufactured by Nippon Miractran Co., Ltd.; Pandex manufactured by DIC Corp.; Pellethane manufactured by Dow Chemical Japan Ltd.; Elastollan manufactured by BASF Japan Ltd.; Estane manufactured by Kyowa Hakko Co., Ltd.; Lezamine P manufactured by Dainichiseika Color & Chemicals Mfg. Co., Ltd.; Hiprene manufactured by Mitsui Chemicals Polyurethanes, Inc.; Mobilon manufactured by Nisshinbo Inc.; Kuramiron U manufactured by Kuraray Co., Ltd.; U-Fine manufactured by Asahi Glass Co.; Sumiflex manufactured by Apco Co.; and Toyobo Urethane manufactured by Toyobo Co., Ltd.

The raw material composition may comprise the above TPU elastomer as the main component. In other words, however, further additives can also be used to the raw material composition. The additive is not particularly limited; however, it is possible to add and use one or more of the additives used in the fiber field such as a flame retardant, a filler, a pigment, a dye, an antioxidant, an ultraviolet absorber and a light stabilizer. If necessary, a TPU other than the above-described appropriate TPUs, for example, non-polyether-based TPU can also be added to the raw material composition, and a diluent such as an organic solvent can also be added to the raw material composition.

However, non-polyether based TPU, especially polyester-based TPU is inferior in water resistance and microorganism corrosion resistance since ester bonds are easily broken by microorganism (enzyme therefrom) and hydrolysis. Thus, it is better to suppress the amount of non-polyether based TPU, for example, 10 wt. % or less, preferably 5 wt. % or less, even 1 wt. % or less based on the total amount of the raw material composition. Here, the term "polyester-based TPU" means a TPU prepared by using one or more polyester polyols as a main component (for example, 50 wt. % or more) of (b) long chain polyol. The term "non-polyether-based TPU" means a TPU prepared by using polyol(s) other than polyether polyol as a main component (for example, 50 wt. % or more) of (b) long chain polyol.

Furthermore, other elastomer/resin such as a polyester resin should also be excluded, for example, the amount of such elastomer/resin should be 1 wt. % or less in the raw material composition.

Among of additives, a following crosslinker may be preferably used together with the TPU elastomer.

Crosslinker

Any type of crosslinker can be used, however, it is preferable to use one or more of crosslinkers selected from reacted compounds which are made from one or more (i) polyols; one or more (ii) isocyanates, and optionally other compound(s). Considering properties of the final product (fiber), one or more of polyether crosslinker may be preferably used. Usually, the molecular weight of the crosslinker is lower than that of the TPU elastomer above.

The polyether crosslinker is prepared by using (i) polyol where at least 50 wt. %, preferably at least 80 wt. %, more preferably at least 95 wt. % of (i) polyol is selected from one or more polyether polyols. In other words, the polyether crosslinker contains one or more units derived from the polyether polyol (polyether polyol unit).

It is not particularly limited but the (i) polyether polyol may be selected from a ring-opening polymer of tetrahydrofuran (polytetramethylene glycol, PTMEG), alkylene oxides (in particular, ethylene oxide, propylene oxide and mixtures of these) and alcohol adducts. More preferably, (i) polyether polyol has a number average molecular weight (Mn) of 500 g/mol to $4.0\times10^3$ g/mol, more preferably 500 g/mol to $2.0\times10^3$ g/mol, particularly $0.8\times10^3$ g/mol to $1.5\times10^3$ g/mol.

(ii) polyisocyanate is not particularly limited but may be selected from an aliphatic and/or cycloaliphatic and optionally also aromatic diisocyanates. For example, (ii) polyisocyanate may be selected from compounds explained above for (a) isocyanate of the preferable TPUs. Among of isocyanates, MDI may be preferably used for the crosslinker.

Such crosslinker preferably has an isocyanate group content (NCO content) of 1.5% to 20%, preferably 2% to 10%, particularly 5% to 6%.

The amount of the polyether crosslinker is not limited but it is preferable to set the amount to 1 wt. % or more, 3 wt. % or more, even 5 wt. % or more based on the total amount of the raw material composition. When melting the main component (TPU elastomer) separately from the other(s) (one or more crosslinkers and/or one or more other additives), the total amount of the raw material composition may be obtained by summing amounts of the main component and others.

The upper limit of the amount of the crosslinker is not particularly limited but in preferred embodiments the upper limit is 25 wt. % or less, 20 wt. % or less, more preferably 15 wt. % or less, based on the total amount of the raw material composition.

It is also possible to use a non-polyether crosslinker where at least 50 wt. % of (i) polyol is selected from the non-polyether polyol (polyol other than polyether polyol), such as polyester-, polycaprolactum- and/or polycarbonate-polyol. However, such non-polyether crosslinker may deteriorate the preferable properties of the final product. Thus, it is preferable to set the amount of the non-polyether crosslinker to less than 5 wt. %, preferably 3 wt. % or less, more preferably 1 wt. % or less, based on the total amount of the raw material composition.

According to the process of the invention, even when the amount of the non-polyether crosslinker is reduced, it is possible to produce fibers improved in mechanical properties at a high manufacturing yield.

Final Product (Fiber)

According to the process as described above, an elastic fiber can be obtained. There is no specific limitation relating mechanical properties and others such as shape or size of the elastic fiber. For example, it is possible to obtain the elastic fiber having an average diameter of more than 20 micrometers, preferably 25 micrometers or more, more preferably 30 micrometers or more, especially 40 micrometers or more, even 50 micrometers or more. The upper limit of the average diameter is not limited but it can be 1,000 micrometers or less, preferably 300 micrometers or less, more preferably 200 micrometers or less. The average diameter can be obtained, for example, by calculating from the fineness (denier) and density of the fiber. The elastic fiber produced by the present invention can be used as a clothing material fiber, an industrial fiber and fiber articles such as a filter. In addition, the elastic fiber produced by the present invention is also suitable for the fiber articles used for the interior of vehicles. Hereinafter, the spinning method using TPU is described more specifically with reference to Examples, but the present invention is not limited to these Examples.

EXAMPLES

A) Investigation of Hard Segment Content

There were prepared a plurality of types of TPUs using the raw materials of MDI as an (a) isocyanate, polytetramethylene glycol as a (b) long chain polyol, and 1,4-butanediol as a (c) chain extender. For each of the TPUs, the Shore hardness, the HS (hard segment) content, and the molecular weight of (b) long chain polyol are described in Table 1 presented below.

Production of High-Speed Spun Elastic Fiber

Figure 2:
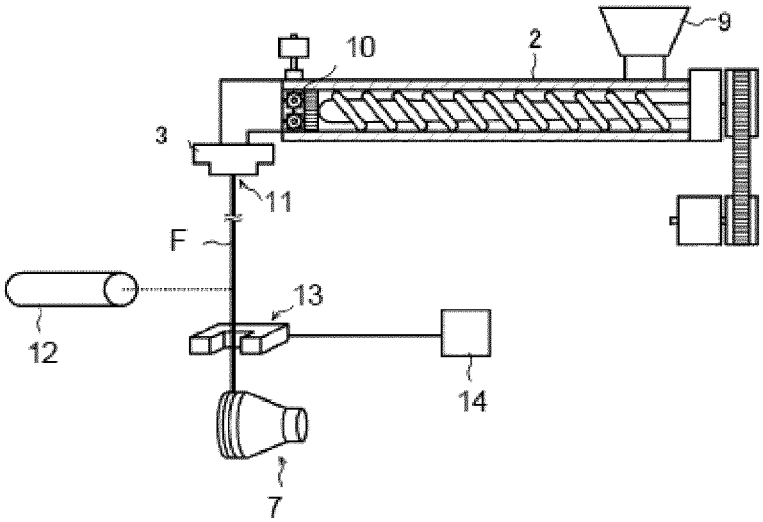
FIG. 2 is a partial cross sectional view illustrating an experimental apparatus.

FIG. 2 is a diagram schematically illustrating the configuration of the melt spinning-measurement apparatus used in Examples, the same members as those in FIG. 1 are denoted by the same reference numerals as in FIG. 1 and the description of such members is omitted. By using the melt spinning-measurement apparatus shown in FIG. 2, and by using each TPU as the raw material composition, at the spinning temperature and the discharge pressure shown in Table 1, a melt spinning was performed from a nozzle (one hole, nozzle diameter 1 mm) to produce a fiber.

Herein, the spinning rate related to the fiber structure formation is the speed between the nozzle hole and the winder 7 (take-up roll), namely, the take-up speed of the take-up roll. The distance from the spinning nozzle to the take-up roll shown in FIG. 2 corresponds to the spinning path length L in FIG. 1. The take-up speed was increased in such a way that the take-up speed was set at 0.27 km/min at the beginning, at 0.5 km/min at the second stage, at 1 km/min at the third stage, and then successively repeatedly set with an increment of 1 km/min; thus the take-up was performed finally at the highest speed, and the maximum take-up speed was evaluated as the spinnability.

TABLE 1

Properties and Spinning Conditions of TPU Samples I to VII

| | Properties of TPU | | | | | Spinning conditions | | |
|---|---|---|---|---|---|---|---|---|
| No. | Shore hardness | HS (% by mass) | Molecular weight of (b) polyol | Density (g/cm$^3$) | MFI (g/10 min) | Maximum take-up speed | Spinning temperature | Discharge pressure MPa |
| I | 74D | 60 | 1,000 | 1.19 | NA | 4 km/min | 240° C. | 4.3 |
| II | 64D | 49 | 1,000 | 1.18 | NA | 2 km/min | 230° C. | 14 |
| II | 64D | 49 | 1,000 | 1.18 | NA | 6 km/min | 240° C. | 4.1 |
| III | 54D | 44 | 1,000 | 1.16 | NA | 5 km/min | 235° C. | 18 |
| IV | 90A | 33 | 1,000 | 1.13 | 10-40 | 6 km/min | 210° C. | 20 |
| V | 85A | 25 | 1,000 | 1.12 | 1-20 | 7 km/min | 210° C. | 21 |
| VI | 80A | 22 | 1,000 | 1.11 | 20-50 | 9 km/min | 210° C. | 23 |
| VII | 75A | 17 | 1,000 | 1.10 | NA | 8 km/min | 210° C. | 18 |

*HS: hard segment,
MFI: melt flow index,
NA: not available

As can be seen from Table 1 presented above, there is a tendency for the maximum take-up speed to be decreased with the increase of the hard segment content of the TPU and the increase of the hardness of the TPU. When the spinning temperature is 230° C., the sample No. II is lower in the maximum take-up speed than the sample No. I. For the other samples, the spinning temperature was determined by increasing the temperature until the spinnability was able to be secured; thus, it is inferred that for the sample No. II, the spinning temperature was not sufficient, and the maximum take-up speed of the sample No. II will be further improved when the spinning temperature is set at a higher temperature (for example, 235° C. or higher). Actually, the maximum take-up speed of the sample No. II became 6 km/min when the spinning temperature was 240° C.

Next, the effect of the high-speed spinning on the elastic fiber was investigated.

Investigation of Speed Variation Profile During High-Speed Melt Spinning

In order to investigate the speed variation profile on the spinning line, an outer diameter-speed measurement was performed on line during the melt spinning of the elastic resin. The outer diameter of the fiber was measured by using an outer diameter meter (Zimmere OHG, Model 460/A10), from a position 10 cm downstream of the discharge nozzle (spinning nozzle) of the spinning head (nozzle) to a position 260 cm downstream of the discharge nozzle at intervals of 10 cm. The sampling frequency was set at 1 kHz, and the measurement time was set at 6 seconds. The measurement of the speed of the fiber was performed by using a laser doppler speed meter (TSI, Ls520), from a position 20 cm downstream of the discharge nozzle of the nozzle to a position 280 cm downstream of the discharge nozzle at intervals of 10 cm, and further at positions of 285 cm and 289 cm downstream of the discharge nozzle. The sampling frequency was set at 1 kHz, and the measurement was continued until a 2,000-point sampling was achieved at each position. The spinning temperatures were as shown in Table 1 presented above.

Figure 3:
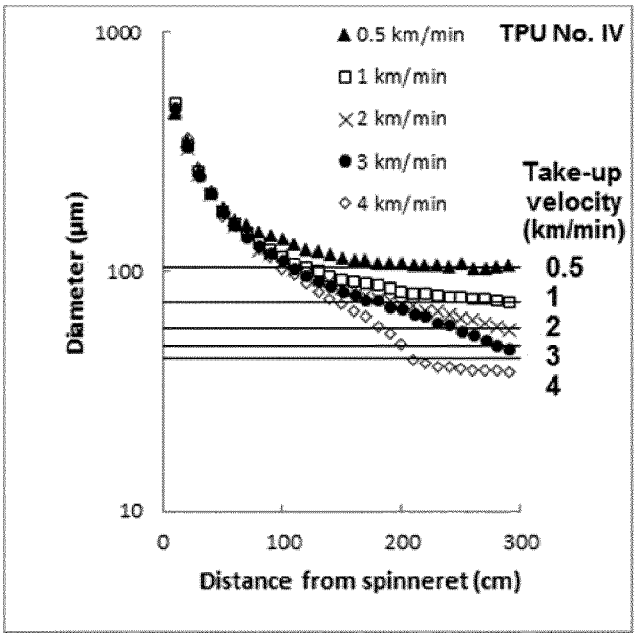
FIG. 3(*a*) to FIG. 3(*d*) are graphs showing the outer diameter variations of fibers.
Figure 3:
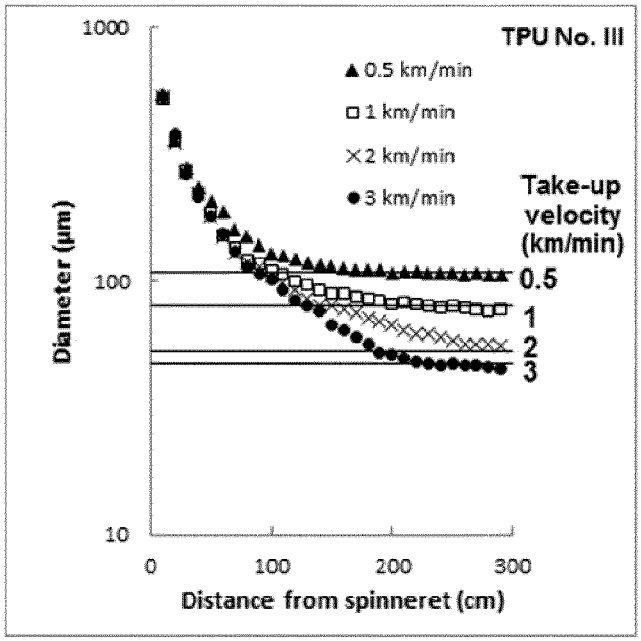

FIG. 3(*a*) to FIG. 3(*d*) show the spinning results of the TPU samples I to IV. The high hardness TPUs (Nos. I to III) underwent the decrease of the fiber diameter (outer diameter) on the more upstream side than the low hardness TPU (No. IV), and maintained the small outer diameters after cutting out. As shown in FIG. 3(*c*), it is possible to increase the spinning rate for TPU, shore 50 D or more (for example, shore 64 D), when increasing the spinning temperature.

Figure 4:
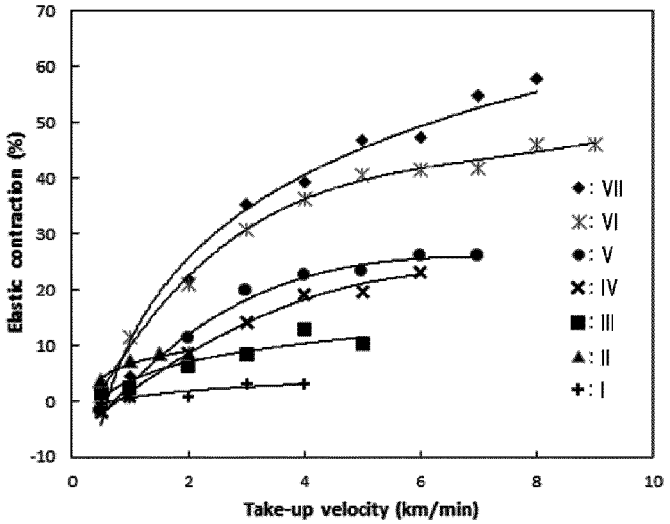
FIG. 4 is a graph showing measurement results of elastic contractions.

FIG. 4 (*a*) shows the elastic contractions C when the fibers were cut out from the take-up roll (bobbin); the elastic contraction C is derived from (I-I')/I in which I represents the fiber length (the circumferential length of the bobbin: 72.25 cm) before the cutting out, and I' represents the fiber length after cutting out the fiber from the bobbin. For example, when the TPUs Nos. II, III and IV are compared with each other under the condition of the same take-up speed, the TPU No. I having a higher Shore hardness was lower in the elastic contraction than the TPUs Nos. II, III and IV each having a lower Shore hardness, especially when the spinning temperature is enough high. Among these, the TPU No. I having the highest Shore hardness exhibited a particularly small elastic contraction, so as to be approximately 3% at a maximum. Accordingly, it has been able to be verified that the higher the Shore hardness of the TPU, the smaller the elastic contraction is.

Next, the initial Young's modulus, the toughness at break, the elongation at break and the tenacity at break were determined by using the "AUTOGRAPH AG-1" manufactured by Shimadzu Corp. As the samples, the respective TPU elastic fibers of 20 mm in length were used. For each of the samples, the cross-sectional areas of three positions were beforehand measured, and as the cross sectional area, the area calculated from the average value of the resulting areas on the basis of the assumption of a perfect circle was used. The test speed was set at 100%/min (namely, 20 mm/min). The initial Young's modulus was read out from the gradient of the stress-strain curve at the rising of the stress. The toughness at break was taken as the integrated value of the stress-strain curve. These tests were each performed five times for each of the samples, and the average values were used.

Figure 5:
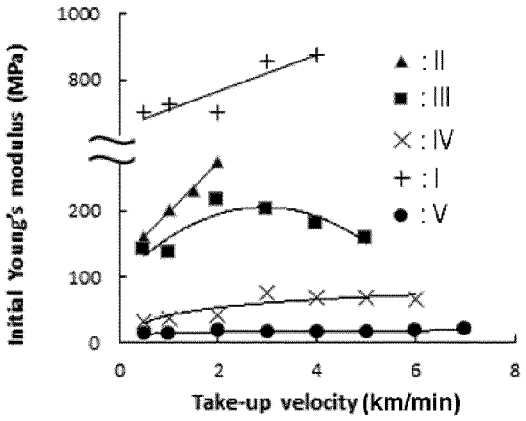
FIG. 5(*a*) is a graph of the initial Young's modulus (initial young modulus), FIG. 5(*b*) is a graph of the toughness, FIG. 5(*c*) is a graph of elongation at break, and FIG. 5(*d*) is a graph showing tenacities.
Figure 5:
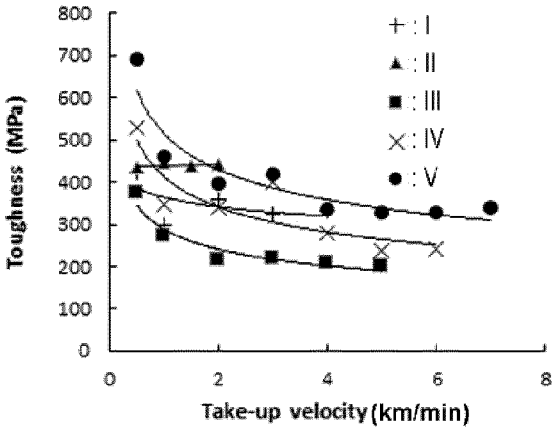

FIG. 5(*a*) shows the measurement results of the initial Young's modulus, FIG. 5(*b*) shows the measurement results of the toughness at break, FIG. 5(*c*) shows the measurement results of the elongation at break, and FIG. 5(*d*) shows the measurement results of the tenacity at break; in the graph of each of these figures, the abscissa represents the take-up speed (spinning rate).

The increase rate of the initial Young's modulus was low even when the spinning rate was high, and there was found a case of the TPU No. III where the initial Young's modulus was decreased in the region of the take-up speed of 2 km/min or more (FIG. 5(*a*)). By increasing the spinning temperature for TPU No. II, the initial Young's modulus becomes high enough at higher take up velocity >3,000 m/min.

The tenacity at break of the TPU No. II at lower spinning temperature 230° C. was reduced to a small extent even when the take-up speed was increased; for each of the other TPU samples, the reduction rate of the toughness was decreased in the take-up speed region of 2 km/min or more (FIG. 5(*b*)). Meanwhile, when the spinning temperature of the TPU No. II becomes higher (240° C.), the toughness of the TPU No. II was decreased as same as other TPU samples.

In conventional TPU fibers (spinning rate less than 1,000 m/min), the elongation at break is 500 to 1,000% and the tenacity is 50 to 100 MPa; however, it has been able to be verified that in the spinning rate region of 2 km/min or more, the elongation at break is particularly small, and the tenacity is particularly high (FIG. 5(*c*), FIG. 5(*d*)).

Figure 6:
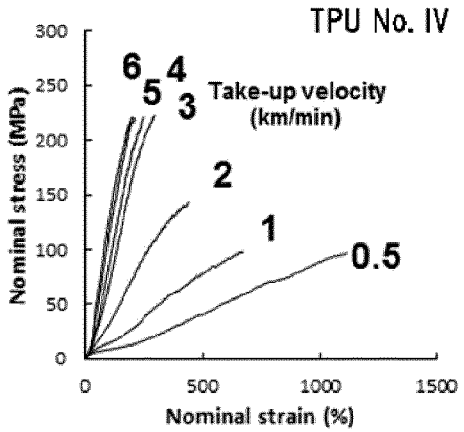
FIG. 6(*a*) to FIG. 6(*d*) are graphs showing stress-strain curves.
Figure 6:
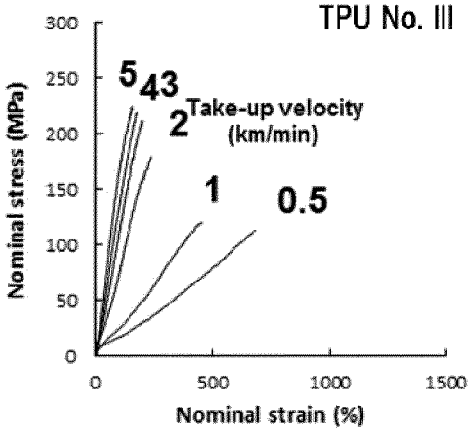

FIG. 6(*a*) to FIG. 6(*d*) show the stress-strain curves (S-S curves). Among of those figures, FIG. 6 (*c*) shows results of TPU II where the spinning temperature is 230° C. In each of these figures, the abscissa represents the nominal strain and the ordinate represents the nominal stress; in each of these figures, the numerals 0.5, 1, 2, 3, 4, 5 and 6 represent the take-up speeds (km/min). The nominal strain is the value obtained by dividing the variation of the length (ΔI) by the original length Lo. As can be seen from FIG. 6(*a*) to FIG. 6(*d*), it has been verified that when the take-up speed (spinning rate) is 2 km/min or more, the tendency for the nominal strain to be decreased is remarkably enhanced.

Figure 7:
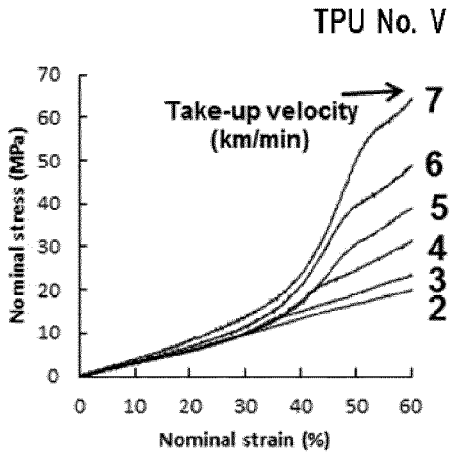
FIG. 7(*a*) to FIG. 7(*c*) are graphs showing the rising portions of the stress-strain curves.
Figure 7:
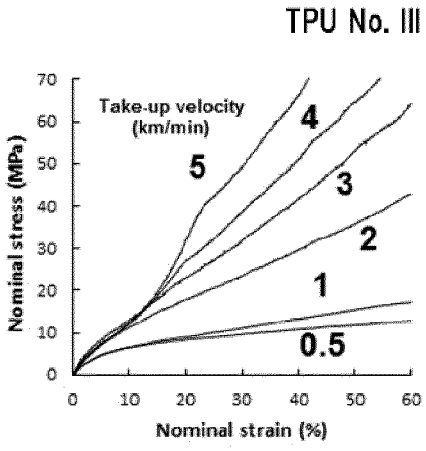

FIG. 7(*a*) to FIG. 7(*c*) are the graphs showing the rising portions of the stress-strain curves, and in each of the graphs, the numerals 0.5, 1, 2, 3, 4, 5 and 6 represent the take-up speeds (km/min), similarly to FIG. 6(*a*) to FIG. 6(*d*). In the TPU No. V having a low hard segment content and a low hardness, the stress-strain curves followed almost the same curves irrespective of the take-up speed within the nominal stress range of approximately 40% or less; in the TPU No. III having a high hard segment content and a high hardness, the stress-strain curves varied differently from each other; in the TPU No. I having a higher hard segment content and a higher hardness, yield points were found.

Investigation of Wide Angle X-Ray Diffraction (WAXD) and Small Angle X-Ray Scattering (SAXS) of Elastic Fiber In order to investigate the wide angle X-ray diffraction (WAXD) and the small angle X-ray scattering (SAXS) of the high-speed spinning elastic fibers, by using the X-ray generator (Rigaku, RMT-18HFVE), X-ray was output at a voltage of 45 kV and a current of 60 mA, and diffraction images were obtained by using a CCD camera (Rigaku, CCD MERCURY). In the wide angle X-ray diffraction (WAXD), each of the diffraction images was obtained with an irradiation time of 10 seconds and a five-times accumulation. In the small angle X-ray scattering (SAXS), each of the diffraction images was obtained with an irradiation time of 5 minutes and a 6-times accumulation.

Figure 8:
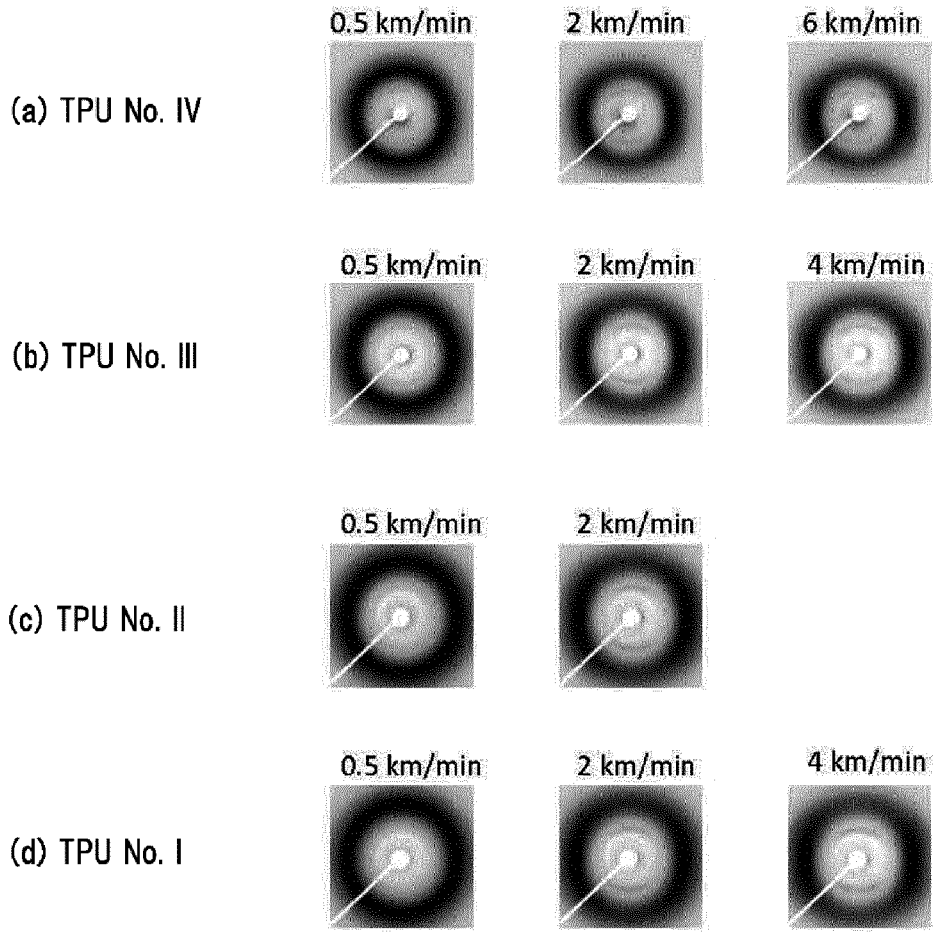
FIG. 8(*a*) to FIG. 8(*d*) show diffraction images of wide angle X-ray diffraction (WAXD).
Figure 9:
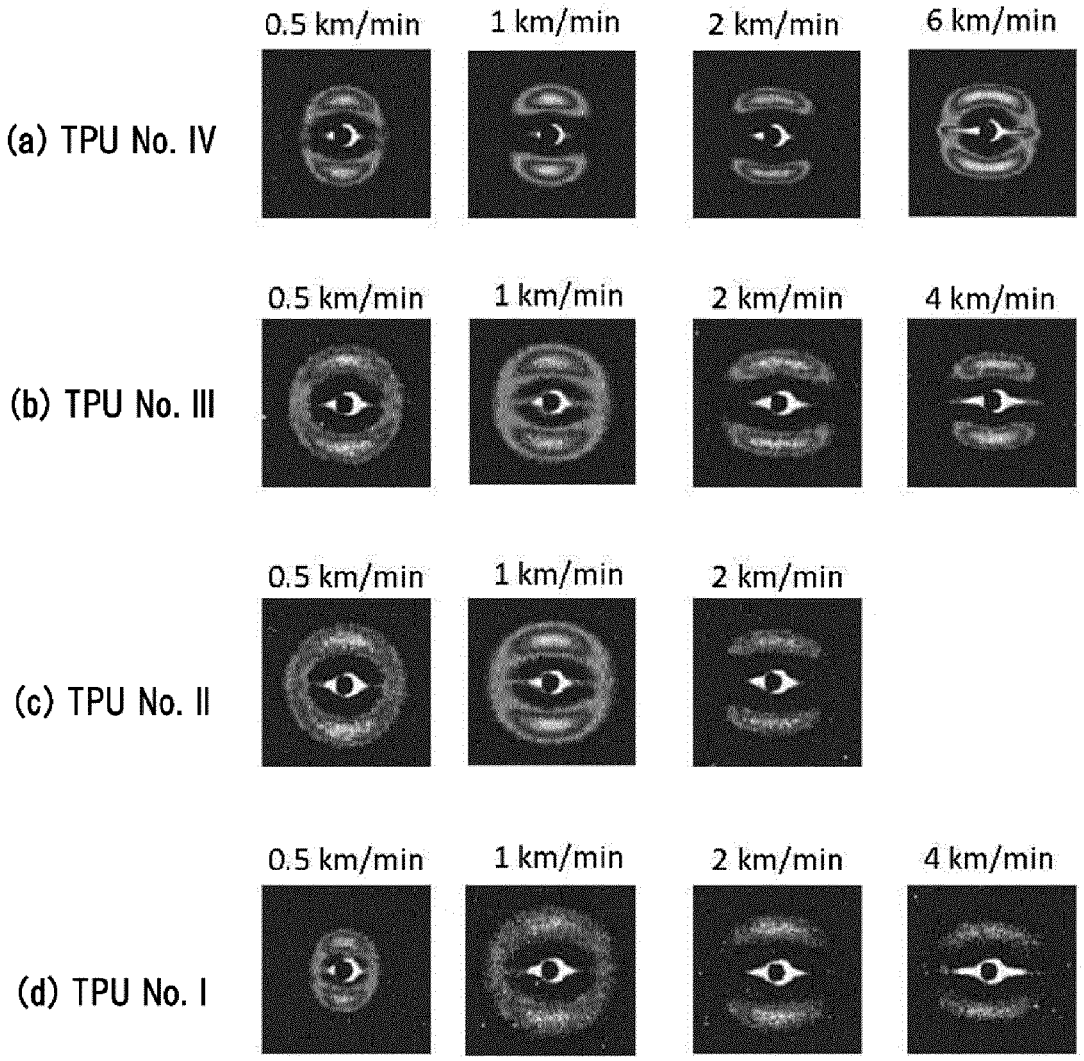
FIG. 9(*a*) to FIG. 9(*d*) show small angle X-ray scattering (SAXS) images.

For the elastic fibers produced by using the TPUs Nos. I to IV, FIG. 8(*a*) to FIG. 8(*d*) show the wide angle X-ray diffraction images, respectively, and FIG. 9(*a*) to FIG. 9(*d*) show the small angle X-ray scattering images, respectively. It is to be noted that in FIGS. 8 and 9, the numerical values accompanied by "km/min" represent the spinning rates of the respective elastic fibers. As can be seen from FIG. 8(*a*) to FIG. 8(*d*), in the wide angle X-ray diffraction images, even when the hard segment content was increased, any definite peak manifesting a crystal was not found. In addition, as can be seen from FIG. 9(*a*) to FIG. 9(*d*), in the small angle X-ray scattering images, the tendency for the images to split to the equatorial direction in terms of the azimuthal angle was small.

Investigation of Elastic Recovery (Hysteresis)

Except that the initial tension (pretension) was absent, and the load strain was set at 100%, according to ASTM-D2731, the elastic recovery (hysteresis) after double elongation (after 100% elongation) was investigated by the following procedure, for each of the first elongation and the fifth elongation, and the energy loss rate (the first elongation) and the elastic recovery (the fifth elongation) were determined.

1. At a strain rate of 100%/min, a strain of 1.0 (a strain of 100% of the initial length) is given to a fiber, and then the length of the fiber is allowed to get back to the initial length at the same rate.

2. The step of the above-described 1 is repeated four times (five times in total), and at the fifth step, after giving strain, the fiber is held for 30 seconds.

3. The length of the fiber is allowed to get back to the initial length, and finally the fiber is stretched until the fiber is broken (the sixth step).

Figure 10:
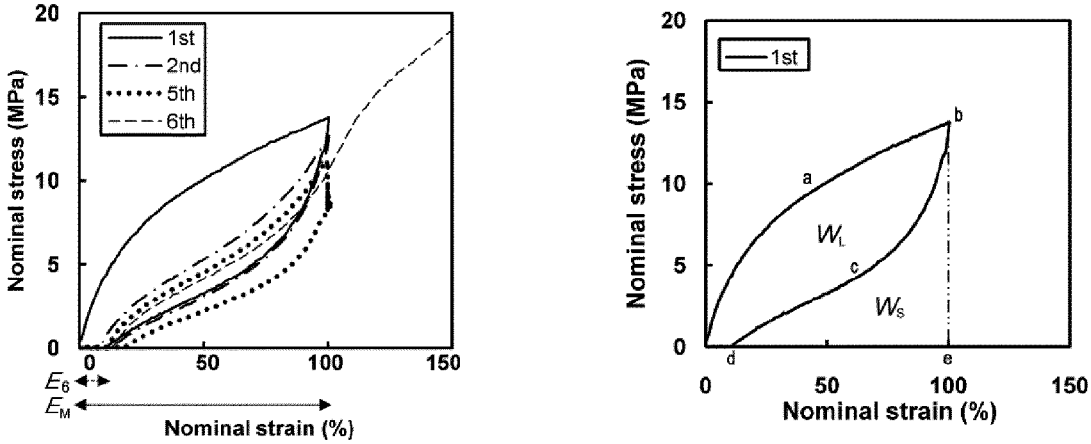
FIG. 10(*a*) is a graph illustrating elastic recovery, and FIG. 10(*b*) is a graph illustrating energy loss rate.

When the fiber was stretched until the fiber was broken in the sixth step, the strain magnitude $E_6$ at which the stress began to rise was determined (FIG. 10(*a*)), and from the strain magnitude $E_6$ (%) and the load strain $E_M$ (%), the elastic recovery was determined on the basis of the following formula.

$$\text{Elastic recovery } [\%]=(E_M-E_6)/E_M\times 100$$

The energy loss rate was determined as follows: in the first strain cycle, from the integrated value of the stress in the process of adding strain, the integrated value of the stress in the process of unloading was subtracted; the resulting value was taken as the energy loss $W_L$ (namely, the area surrounded by 0abcd0 in FIG. 10(*b*)), and the energy loss rate was determined on the basis of the following formula.

$$\text{Energy loss rate } [\%]=W_L/(W_L+W_S)\times 100$$

Here, $W_S$ represents the area surround by dcbed in FIG. 10(*b*).

Figure 11:
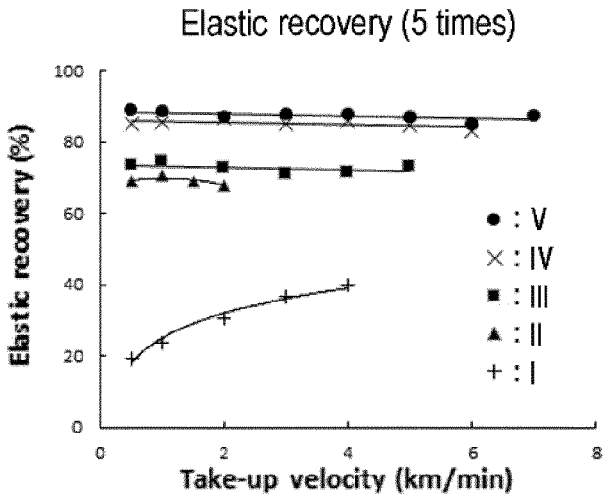
FIG. 11(*a*) is a graph showing elastic recoveries, and FIG. 11(*b*) is a graph showing energy loss rates.
Figure 11:
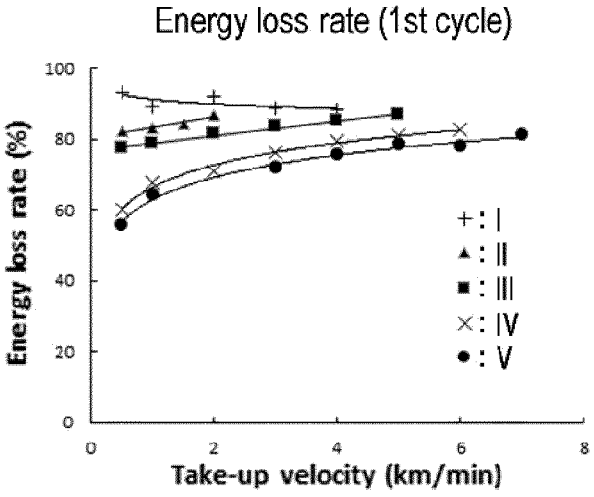

In FIG. 11(*a*) and FIG. 11(*b*), I to V correspond to the sample numbers of the TPU in Table 1, respectively. As can be seen from FIG. 11(*a*) and FIG. 11(*b*), it has been verified that the lower the hard segment content and the lower the hardness, the higher is the elastic recovery (the fifth operation) and the lower is the energy loss. The TPU No. I having the highest Shore hardness was remarkably lower in the elastic recovery as compared with the other TPUs; however, it has been verified that in the TPU No. I, with the increase of the take-up speed, the elastic recovery is increased, and the energy loss is also decreased.

It was found that birefringence becomes enough high by increasing the take up velocity, especially more than 3,000 m/min and it is understood that the orientation degree of each sample became higher. Further, higher average refractive index by decreasing hardness, especially shore 64 D or less, of the TPU was found and thus the lower hardness makes the crystallization degree higher.

Summary of Hard Segment Content

When increasing the hard segment content of the TPU to be used for high speed melt-spinning, it was possible to obtain TPU elastic fibers having a smaller elastic contraction even at a higher melt-spinning rate. Although the TPU fiber having the higher hard segment content showed the Young's modulus higher than, the recovery characteristic thereof became worse. Besides, their rising portions of stress-strain curves differ from each other. As same as other TPU fibers, the TPU fiber having the high hard segment content did not show a definite spot in the WAXD image, however, the DSC (Differential Scanning Calorimetry) result showed an endothermic peak around 200° C., supposed to be a peak derived from the hard segment melting.

B) Investigation of Molecular Weight of Polyol

As shown in Table 2 below, properties of elastic fibers were tested in conditions as same as "A) Investigation of Hard Segment Content", by using TPU samples where (b) polyol molecular weights of soft segments were different from each other.

TABLE 2

Properties and Spinning Conditions of TPU Samples 2-I to 2-V

| | Properties of TPU | | | | | Spinning conditions | | |
|---|---|---|---|---|---|---|---|---|
| No. | Shore hardness | HS (% by mass) | Molecular weight of (b)polyol | Density (g/cm$^3$) | Molecular weight of TPU | Spinning temperature | Discharge Pressure MPa | Maximum take-up speed |
| 2-I | 85A | 21 | 700 | 1.13 | $17.9 \times 10^4$ | 230° C. | 11 | 6 km/min |
| 2-II | 85A | 25 | 1,000 | 1.12 | $36.0 \times 10^4$ | 215° C. | 21 | 7 km/min |
| 2-V | 90A | 29.5 | 1,500 | 1.11 | $37.2 \times 10^4$ | 240° C. | 12 | 6 km/min |
| 2-III | 85A | 25 | 2,000 | 1.11 | $31.5 \times 10^4$ | 240° C. | 19 | 3 km/min |
| 2-IV | 85A | 27 | 3,000 | 1.10 | $16.0 \times 10^4$ | 275° C. | 17 | 2 km/min |

For each TPU sample 2-I to 2-V, the weight-average molecular weight (standard polystyrene conversion) of the whole TPU was measured by using a gel permission chromatography device HLC-8820GPC (produced by Tosoh, following two columns were used: TSKgel SuperHZM-H). The results were also shown in Table 2.

Figure 12:
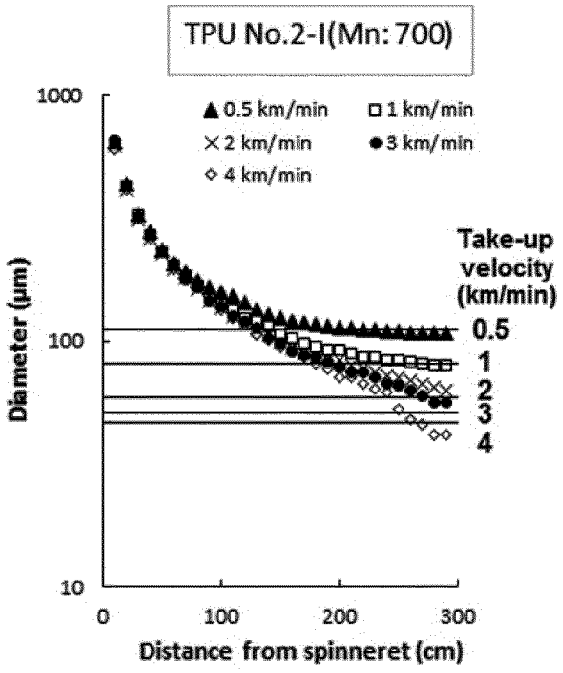
FIG. 12(*a*) to FIG. 12(*d*) are graphs showing the outer diameter variations of the fibers for sample No. 2-I to 2-IV.
Figure 12:
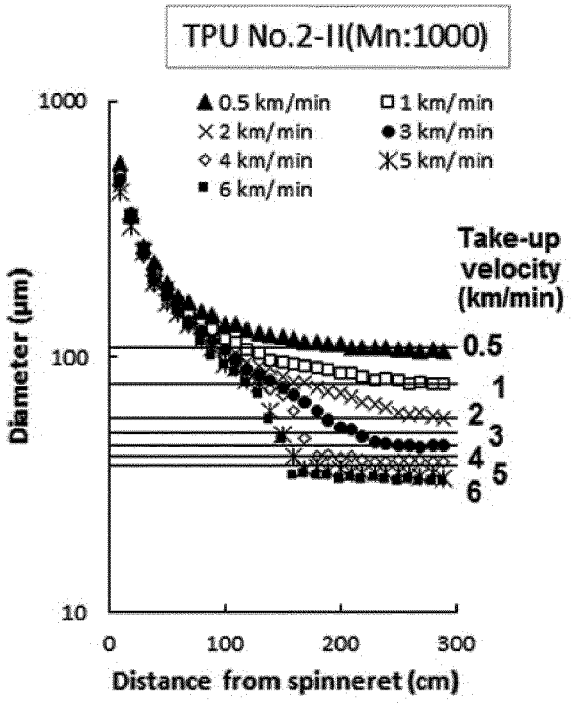

FIG. 12(*a*) to FIG. 12 (*d*) show results of online diameter measurements and Mn value for samples No. 2-1 to 2-IV and 2-V within parenthesis shows the molecular weight of polyol in each Figure. Comparing FIGS. 12(*a*) to 12(*d*), the higher molecular weight of the polyol as the component of the soft segment made the solidification point closer to the nozzle (spinneret) and thus the region where the diameter was unchanged became broader.

Although the shore hardness was low (85 A), the high speed spinning more than 2 km/min became difficult even if adjusting the spinning temperature when using (b) long chain polyol having 3,000 or more of the molecular weight. Although the entire molecular weight of TPU 2-IV was not so different from those of other TPU 2-I to 2-III and 2-V, TPU 2-IV showed a very high melt viscosity and a poor spinning property at high speed. Therefore, the preferable molecular weight of (b) long chain polyol is less than 3,000, more preferably less than 2,000 when higher spinning rate is required for improving fiber properties.

It was found that the bigger a nozzle diameter is, the bigger is melt stretch ratio, and thus the solidification by an orientationally crystallization is occurred at upper stream side (i.e., closer to the nozzle), as shown by results of online diameter measurements for TPU No. 2-V where the nozzle diameter was changed from 1.0 mm to 0.5 mm.

It was found that when the take-up speed became high enough (3 km/min), samples No. 2-I, 2-II and 2-V (polyol Mn<2,000) shows very similar curves, as shown by results of online diameter measurements to compare TPUs No. 2-I to No. 2-V.

Figure 13:
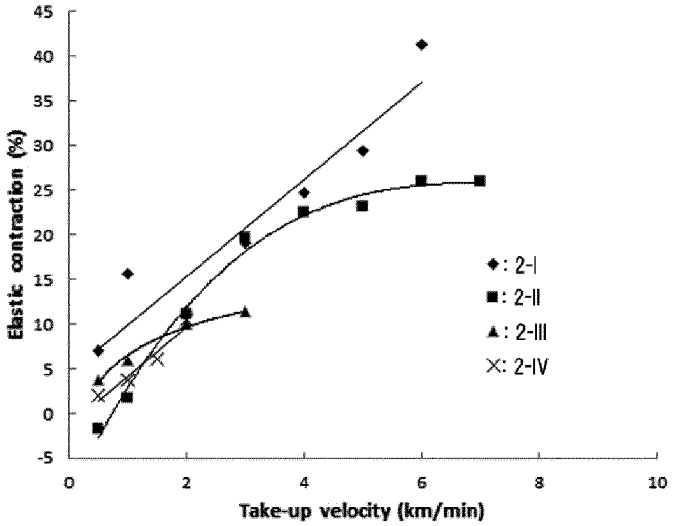
FIG. 13 is a graph showing the measurement results of the elastic contraction.

FIG. 13 shows measurement results of elastic contractions C when the fibers were cut out from the bobbin. In FIG. 13, the ordinate represents the elastic contraction C, the abscissa represents the take-up speed and 2-I to 2-V represent sample number of TPUs respectively. According to the measurement results of elastic contractions C, it was confirmed that the molecular weight of the long chain polyol in the soft segment becomes smaller, the elastic contraction C becomes higher.

Figure 14:
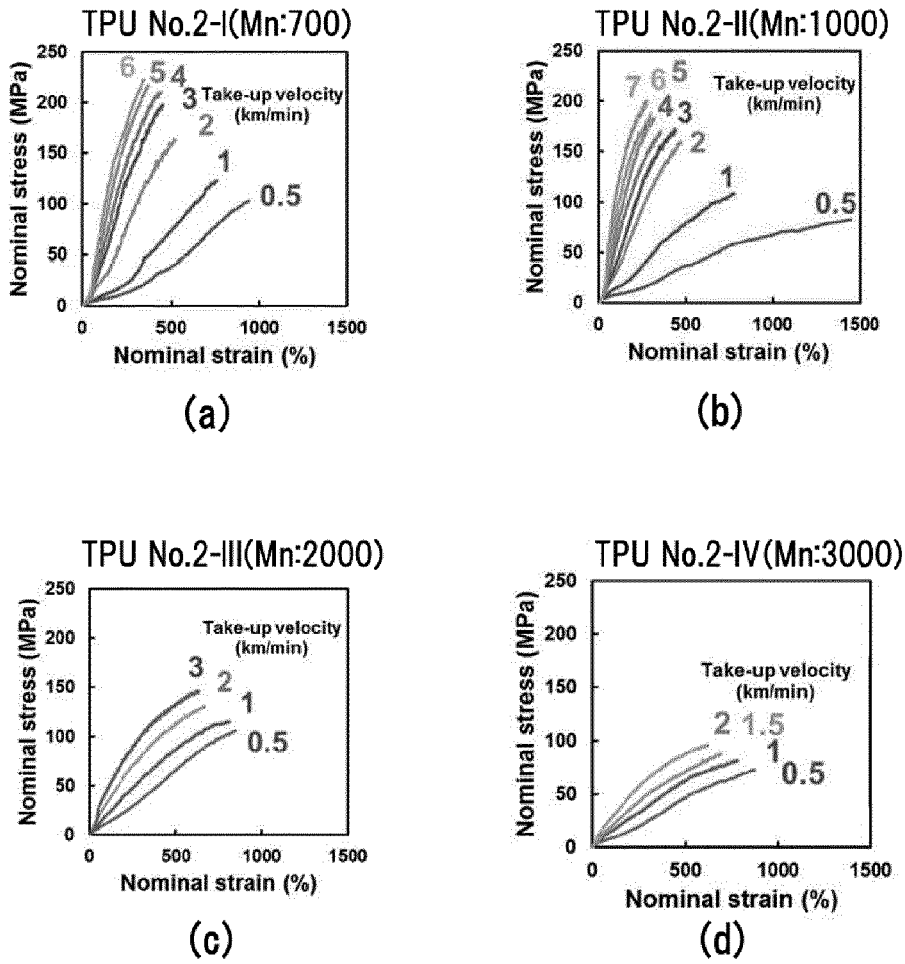
FIG. 14(*a*) to FIG. 14(*d*) are the graphs showing the stress-strain curves.

FIGS. 14 (*a*) to 14 (*d*) show measurement results of the stress-strain curves; in each of these figures, the abscissa represents the nominal strain and the ordinate represents the nominal stress; in each of these figures, the numerals 0.5, 1 . . . , 5 and 6 represent the take-up speeds (km/min). As shown in FIGS. 14 (*a*) to 14(*d*), the molecular weight of the long chain polyol in the soft segment becomes bigger, the fiber tenacity becomes smaller. Comparing the results obtained, it seems that the change of the nozzle diameter did not affect the stress-strain curves so much.

Figure 15:
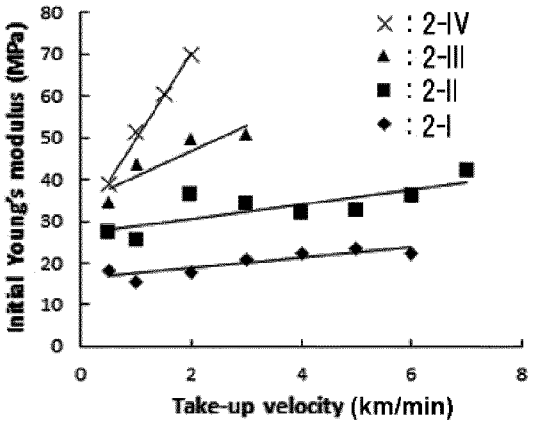
FIG. 15(*a*) is a graph of initial Young's modulus, FIG. 15(*b*) is a graph of toughness, FIG. 15(*c*) is a graph of elongation at break and FIG. 15(*d*) is a graph showing tenacity.
Figure 15:
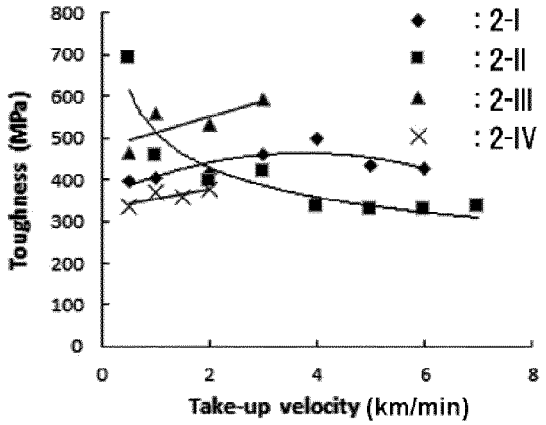

FIG. 15(*a*) shows the measurement results of the initial Young's modulus, FIG. 15(*b*) shows the measurement results of the toughness, FIG. 15(*c*) shows the measurement results of the elongation at break, and FIG. 15(*d*) shows the measurement results of the tenacity; in the graph of each of these figures, the abscissa represents the take-up speed (spinning rate) and 2-I to 2-IV show sample numbers of TPUs respectively.

TPU No. 2-IV (long chain molecular weight=3,000) showed a remarkable increase of Young's modulus against to the spinning rate (FIG. 15(*a*)). On the other hand, TPU Nos. 2-I to 2-III (long chain molecular weight<3,000) showed remarkable increases of the tenacity (FIG. 15 (*d*)) by increasing the take-up speed and little decreases of the elongation in the region of 2 km/min or more of the spinning rate (FIG. 15(*c*)). Although a decreases of the toughness was observed in some of them, the decrease was very little (FIG. 15(*b*)).

Investigation of Wide Angle X-Ray Diffraction (WAXD) and Small Angle X-Ray Scattering (SAXS) of Elastic Fiber Wide angle X-ray diffraction images and small angle X-ray scattering images were obtained for fibers produced by using TPUs as shown in Table 2, in the same manner as that in "A) Investigation of Hard Segment Content". The results were shown in FIGS. 16(*a*) to 16(*d*) and FIGS. 17(*a*) to 17(*d*).

Figure 16:
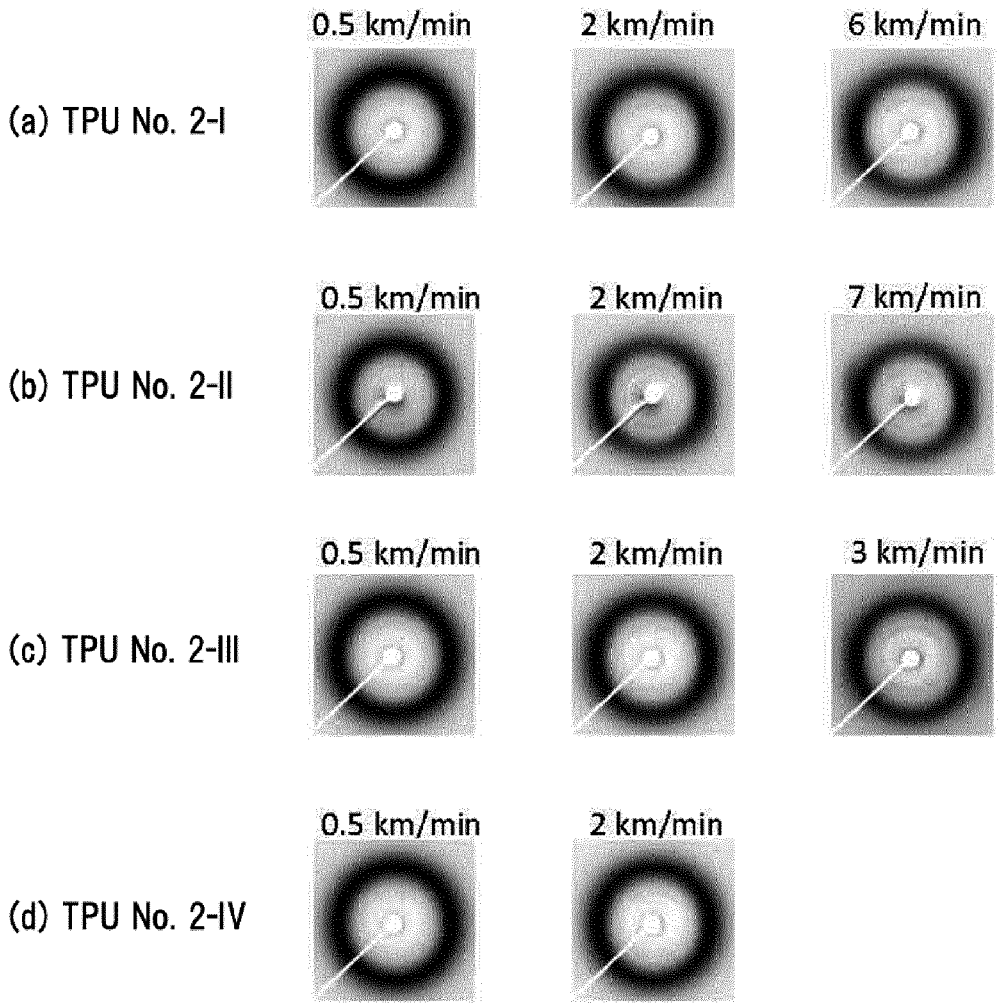
FIG. 16(*a*) to FIG. 16(*d*) show diffraction images of wide angle X-ray diffraction (WAXD).
Figure 17:
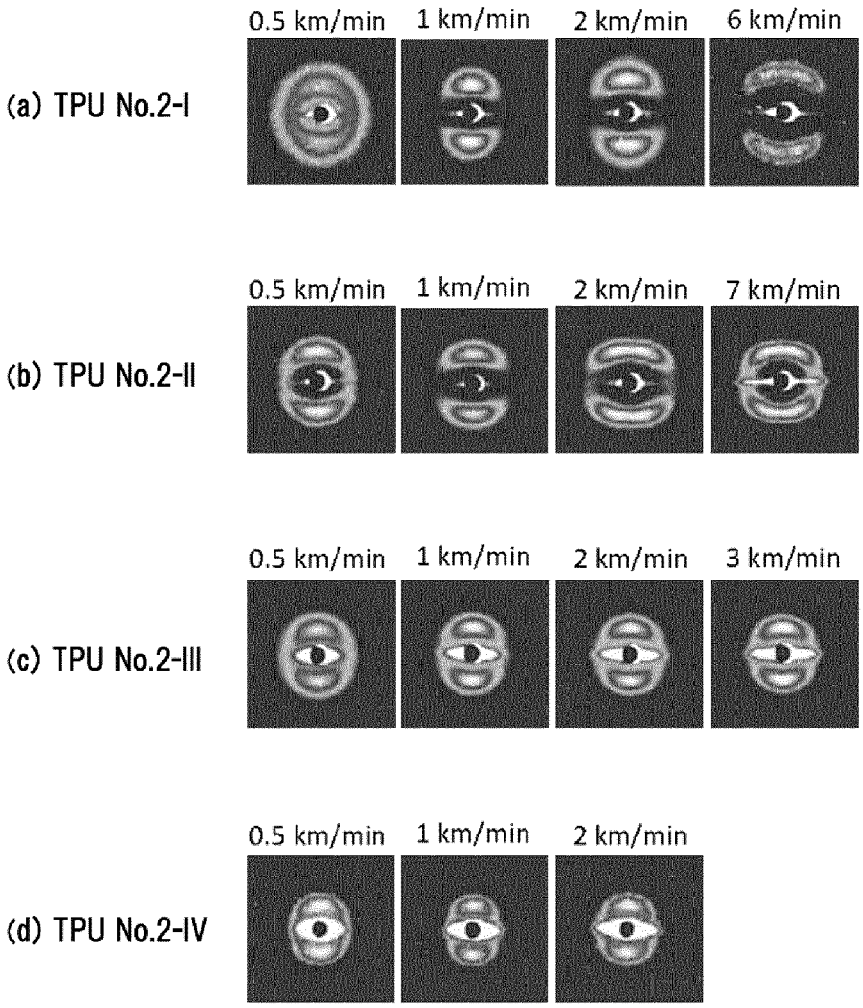
FIG. 17(*a*) to FIG. 17(*d*) show images of small angle X-ray scattering (SAXS).

As shown in FIGS. 16(*a*) to 16(*d*), the wide angle X-ray diffraction did not show definite spots even when (b) polyol having higher molecular weight was used. Similar to FIGS. 9(*a*) to 9(*d*), small angle X-ray scattering images of FIGS. 17(*a*) to 17(*d*) showed tendencies the two-spot image became close to the four-spot image as the spinning rate was increased, and the diffraction image along the equatorial direction became definite as the molecular weight of (b) long chain polyol was increased.

Investigation of Elastic Recovery (Hysteresis)

Figure 18:
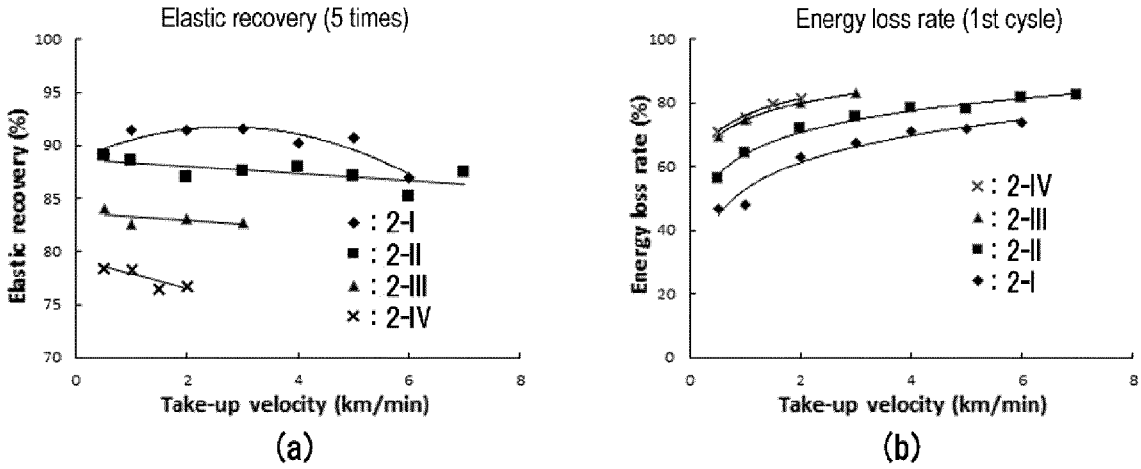
FIG. 18(*a*) shows elastic recoveries and FIG. 18(*b*) shows energy loss rate.

The elastic recovery and energy loss were determined in the same manner as those in "A) Investigation of Hard Segment Content". Results were shown in FIGS. 18(*a*) to 18(*b*). As shown in FIG. 18(*a*), the higher molecular weight of (b) long polyol deteriorated the elastic recovery, especially when comparing the results of "5 times" and "1 st and 2 nd". Further, as shown in FIG. 18(*b*), the higher molecular weight of (b) long chain polyol made the energy loss higher, especially when (b) long chain polyol has Mn>2,000.

Summary of Molecular Weight of Long Chain Polyol

When (b) long chain polyol having higher molecular weight was used for the TPU fiber, the solidification was occurred at a position closer to the nozzle hole and thus it was assumed that its crystallization speed was higher. However, the WAXD showed no definite spot while the SAXS clearly showed the definite diffraction image along the equatorial direction. With regard to mechanical properties of the TPU fiber, when (b) long chain polyol having higher molecular weight was used for the TPU fiber, its initial Young's modulus became higher and its properties depended on the spinning rate, however, the tenancy was weak. According to the DSC measurement, the TPU sample No. 2-IV showed a peak (endothermic energy peak around 10° C.) which was supposed to be a peak derived from the melt of (b) long chain polyol crystal.

DESCRIPTION OF THE REFERENCE NUMBERS

1 apparatus
2 extruder
3 spinning head
4 godet roller
5 godet roller
6 take-up roller
7 winder
9 feed opening
L spinning path length
F fiber
10 gear pump
11 discharge nozzle (spinning nozzle)
12 laser Doppler speed meter
13 outer diameter meter
14 analysis device

What is claimed:

1. A process for producing an elastic fiber comprising:
discharging a raw material composition from a nozzle to form a fiber;
drawing down the fiber from the nozzle; and
taking up the fiber around a take-up roll, wherein
a spinning rate is set to 2,500 m/min to 10,000 m/min where the spinning rate means a running speed of the fiber travelling from the nozzle to the take-up roll, wherein
the raw material composition comprises a thermoplastic polyurethane,
wherein the raw material composition comprises less than 5 wt. % of a non-polyether crosslinker, and
wherein the raw material composition comprises a crosslinker containing one or more of polyether polyol units.

2. The process according to claim 1, wherein the spinning rate is set to 3,000 m/min to 10,000 m/min.

3. The process according to claim 1, wherein the elastic fiber obtained by the process has a diameter of more than 20 micrometers.

4. The process according to claim 1, wherein the thermoplastic polyurethane has a hard segment-content of 10 wt. % to 60 wt. %.

5. The process according to claim 1, wherein the thermoplastic polyurethane is the reaction product of
(a) an isocyanate,
(b) a polyol,
and optionally
(c) a chain extender,
optionally in the presence of
(d) a catalyst, and/or
(e) an auxiliary agent.

6. The process according to claim 5, wherein the polyol has a number average molecular weight from 500 g/Mol to 2,000 g/Mol.

7. The process according to claim 5, wherein the polyol comprises at least 50 weight-% of a polyetherpolyol based on a total amount of the polyol.

8. The process according to claim 7, wherein the polyetherpolyol is polytetrahydrofuran.

9. The process according to claim 5, wherein the isocyanate is 2,2'-, 2,4'- and/or 4,4'-dicyclohexylmethane diisocyanate.

10. The process according to claim 5, wherein the chain extender is present, and is 1,4-butandiol.

11. The process according to claim 1, wherein the thermoplastic polyurethane has a shore hardness 74 D or less.

12. A process for producing an elastic article by using an elastic fiber produced by the process according to claim 1.

* * * * *